US009759441B2

(12) United States Patent
Tadokoro et al.

(10) Patent No.: US 9,759,441 B2
(45) Date of Patent: Sep. 12, 2017

(54) AIR-CONDITIONING APPARATUS

(75) Inventors: Takahide Tadokoro, Tokyo (JP); Takashi Ikeda, Tokyo (JP); Shingo Hamada, Tokyo (JP); Mitsuhiro Shirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 693 days.

(21) Appl. No.: 14/119,197

(22) PCT Filed: Mar. 29, 2012

(86) PCT No.: PCT/JP2012/002178
§ 371 (c)(1),
(2), (4) Date: Nov. 21, 2013

(87) PCT Pub. No.: WO2012/169100
PCT Pub. Date: Dec. 13, 2012

(65) Prior Publication Data

US 2014/0102676 A1 Apr. 17, 2014

(30) Foreign Application Priority Data

Jun. 10, 2011 (JP) ..... 2011-130031

(51) Int. Cl.
*F24F 7/007* (2006.01)
*F04D 17/04* (2006.01)
(Continued)

(52) U.S. Cl.
CPC ..... *F24F 7/007* (2013.01); *F04D 17/04* (2013.01); *F04D 29/4226* (2013.01);
(Continued)

(58) Field of Classification Search
CPC ..... F04D 29/28; F04D 29/281; F04D 29/282; F04D 29/283; F04D 29/30; F04D 17/04
See application file for complete search history.

(56) References Cited

FOREIGN PATENT DOCUMENTS

JP 50-14006 U 2/1975
JP 56-139890 U 10/1981
(Continued)

OTHER PUBLICATIONS

Office Action mailed Jul. 3, 2015 in the corresponding CN Patent application No. 201280028437.5 (with English translation).
(Continued)

*Primary Examiner* — Gregory Anderson
*Assistant Examiner* — Cameron Corday
(74) *Attorney, Agent, or Firm* — Posz Law Group, PLC

(57) ABSTRACT

The length of a cross flow fan in the rotational axis direction is longer than the length of an air outlet in the longitudinal direction, and the cross flow fan has a fan extension positioned beyond each end of the air outlet in the rotational axis direction. Deflectors are provided in the air-conditioning apparatus main body. An outlet airflow blown from each fan extension of the cross flow fan impinges upon a corresponding one of the deflector. Furthermore, the shape of blade portions of the fan extensions of the cross flow fan and the shape of blade portions opposing the air outlet are different from each other. The wind speed of the outlet airflow blown from the blade portion is lower than the wind speed of an outlet airflow blown from the blade portion.

10 Claims, 24 Drawing Sheets

(51) Int. Cl.

| | |
|---|---|
| ***F24F 1/00*** | (2011.01) |
| ***F04D 29/42*** | (2006.01) |
| ***F24F 13/24*** | (2006.01) |

(52) U.S. Cl.
CPC ..... *F24F 1/0011* (2013.01); *F24F 1/0025* (2013.01); *F24F 13/24* (2013.01)

(56) References Cited

FOREIGN PATENT DOCUMENTS

| | | | | |
|---|---|---|---|---|
| JP | 58-122396 | A | | 7/1983 |
| JP | 02-199297 | A | | 8/1990 |
| JP | 03-194196 | | * | 8/1991 |
| JP | 04-190023 | A | | 7/1992 |
| JP | 04190024 | A | | 7/1992 |
| JP | 4190024 | | * | 8/1992 |
| JP | 06-033893 | A | | 2/1994 |
| JP | 08-319990 | A | | 12/1996 |
| JP | 2001-201078 | A | | 7/2001 |
| JP | 2001-207990 | A | | 8/2001 |
| JP | 2009-250601 | | * | 10/2009 |
| JP | 2009-250601 | A | | 10/2009 |

OTHER PUBLICATIONS

Extended European Search Report mailed Mar. 20, 2015 in the corresponding European Patent application No. 12796903.8.

Notification of Reason for Refusal issued from the Japanese Patent Office dated Nov. 1, 2012 for the corresponding Japanese Patent Application No. 2011-130031. (with English translation).

Notification of Reason for Rejection issued from the Japanese Patent Office dated Jun. 11, 2013 for the corresponding Japanese Patent Application No. 2011-130031. (with English translation).

International Search Report of the International Searching Authority mailed Jun. 5, 2012 for the corresponding international application No. PCT/JP2012/002178.

* cited by examiner (a)

(b)

(a)

(b)

(a)

(b)

AIR-CONDITIONING APPARATUS

CROSS REFERENCE TO RELATED APPLICATIONS

This application is a U.S. national stage application of PCT/JP2012/002178 filed on Mar. 29, 2012 and is based on Japanese Patent Application No. 2011-130031 filed on Jun. 10, 2011, the contents of which are incorporated herein by reference.

TECHNICAL FIELD

The present invention relates to an air-conditioning apparatus and in particular relates to an indoor unit of a separate-type air-conditioning apparatus equipped with the indoor unit and an outdoor unit.

BACKGROUND

An indoor unit of an air-conditioning apparatus is installed in a room (in a room of a house or office) subjected to air conditioning. Indoor air sucked through the air inlet exchanges heat in a heat exchanger with a refrigerant circulated in a refrigeration cycle so as to heat the indoor air during heating operation and cool the indoor air during cooling operation. The indoor air heated or cooled is blown into the room through the air outlet. For this purpose, a fan and a heat exchanger are housed in an indoor unit main body.

Among many types of the existing indoor units of the air-conditioning apparatuses, it is well-known that some types of the indoor units such as a wall-installation type, which have an elongated air outlet, and a ceiling concealing type, which blows air in a single direction, use cross flow fans (also referred to as tangential fans or transverse fans) as their air sending device. With respect to an airflow flowing from an air inlet to an air outlet in the indoor unit of the air-conditioning apparatus, a heat exchanger is disposed upstream of the cross flow fan, that is, the heat exchanger is disposed between the air inlet and the cross flow fan, and the air outlet is positioned downstream of the cross flow fan. The length of the air outlet of the indoor unit in the longitudinal direction is substantially the same as the entire length of the cross flow fan in the longitudinal direction (rotational axis direction). Components such as drive motor and support portions that support the rotating shaft of the cross flow fan are disposed further to the outside in the longitudinal direction of the both ends of the cross flow fan with a space between these components and each end of the cross flow fan.

The cross flow fan (simply referred to as "fan" hereafter) includes a plurality of individual impeller units connected to one another in the rotational axis direction. In each of the individual impeller units, a plurality of blades, each of which is curved so as to have an arc shape in section, are secured to an annular (ring-shaped) support plate, which is a flat plate having outer and inner diameters. The blades are inclined by a predetermined angle relative to the support plate and secured to the support plate so as to form concentric annular shapes. A discoid end plate is secured to ends of the blades of the individual impeller unit at one end in the rotational axis direction. The rotating shaft supported by a bearing portion of the indoor unit main body is attached to the end plate. The individual impeller unit at the other end in the rotational axis direction includes an end plate with a boss. Unlike the support plates in other portions, the end plate with a boss has a boss portion at its center. The motor rotating shaft of the drive motor is secured to the boss. When the drive motor rotary drives, the fan is rotated about the rotational axis, which is the center of the rotating shaft. The blades are inclined so that their respective outer circumferential blade ends are positioned at the front in the rotational direction.

Hereafter, each of the individual impeller units arranged in series in the rotational axis direction is referred to as a "unit" of the fan for the convenience of description. The individual impeller unit located at each end of the fan in the rotational axis direction is referred to as an "end unit."

As the fan is rotated, indoor air is sucked into the indoor unit main body of the air-conditioning apparatus through the air inlet. The sucked air becomes conditioned air, the temperature of which has been adjusted as described above while passing through the heat exchanger. The conditioned air crosses the fan, and after that, passes through an air path that extends to the air outlet and is blown into the room through the air outlet formed in a lower portion of the indoor unit main body.

The pressure inside the indoor unit is lower than the atmospheric pressure because of frictional resistance (pressure loss) applied to air while the air is passing through the heat exchanger. The fan provides energy to the airflow so that the airflow surpasses the atmospheric pressure, thereby blowing the air from the air outlet. However, when the energy provided to the airflow from the fan is not sufficient to surpass the atmospheric pressure, the pressure inside the indoor unit becomes lower than the atmospheric pressure outside the indoor unit. In this case, indoor air is sucked into the indoor unit through the air outlet. This phenomenon is referred to as "reverse suction."

Reverse suction tends to occur near the both ends of the fan in the rotational axis direction. The reason of this is as follows.

At each end of the fan in the rotational axis direction, an end plate, which is part of the individual impeller unit as a rotating body, and a side wall of the indoor unit main body are disposed. The side wall defines a side surface of an air path and is disposed further to the outside than the end plate so as to oppose the side plate. The end plate and the side plate are spaced apart from each other by about 5 mm so as to prevent the occurrence of rotational friction, which may otherwise occur due to contact of the end and side plates with each other. A space formed between the end plate and the side wall opposite the end plate is positioned at the outside of each end of the fan in the rotational axis direction. This space is in an atmosphere in which the pressure is lower than the atmospheric pressure due to the pressure loss while the air is passing through the heat exchanger. Thus, it is considered that reverse suction tends to occur due to the pressure difference between the pressure in the space and the atmospheric pressure outside the indoor unit. When reverse suction occurs, the air volume of the entire fan is reduced, thereby degrading the performance of the fan. Furthermore, turbulence of the airflow is caused by reverse suction, thereby increasing noise. When reverse suction occurs during cooling operation, droplets of condensed water may scatter in the room (this scattering is referred to as "scattering of water droplets"). The scattering of water droplets is a phenomenon in which high-humidity indoor air having flowed into the indoor unit due to reverse suction is condensed through its contact with low-temperature wall surfaces inside the indoor unit, and the condensed water then becomes water droplets and may be scattered into the room. In particular, when draft resistance is increased by, for example, dust accumulated in the air inlet, sufficient energy is unlikely to be provided by the fan, and accordingly, occurrence of reverse suction is facilitated.

There is an example of a structure in order to prevent above-described reverse suction. In this structure, a member having an outer circumstantial surface is attached to each end of the cross flow fan in the rotational axis direction. The size of the member is increasing toward each side surface so as to form a bell shape. With the bell-shaped member, the gap between each end of the fan in the rotational axis direction and a space, in which the pressure is lower than the atmospheric pressure, formed outside the end of the fan is reduced so as to prevent the reverse suction (for example, see Patent Literature 1).

PATENT LITERATURE

Patent Literature 1: Japanese Unexamined Patent Application Publication No. 6-33893 (paragraphs 0009 to 0013 and FIGS. 1 and 3)

The member having the outer circumferential surface, the size of which is increasing toward the side wall so as to form a bell shape, provided at each end of the fan in the rotational axis direction (longitudinal direction) is intended to block air that attempts to flow into the space between the end of the fan and the side wall. The air that attempts to reversely flow into the indoor unit through each end of the air outlet is caused to flow back toward the air outlet by the bell-shaped outer circumferential surface, thereby reverse suction is prevented. However, in order to eliminate generation of the rotational friction between the ends of the fan and the side walls, the gaps between the rotating fan and the fixed side walls of the indoor unit main body of the air-conditioning apparatus cannot be completely eliminated. Thus, it is difficult to prevent reverse suction, which is generated by air passing through the gap between each of the members having the bell-shaped expanded outer circumferential surface and a corresponding one of the side walls.

SUMMARY

The present invention is proposed in order to solve the above-described problem. An object of the present invention is to obtain an air-conditioning apparatus, in which reverse suction can be prevented, a large air volume can be maintained, and power consumption and noise can be reduced.

An air-conditioning apparatus according to the present invention includes an indoor unit main body that has an air inlet, through which indoor air is sucked, and an air outlet elongated in a left-right direction, from which air is blown.

The air-conditioning apparatus also includes a cross flow fan provided in the indoor unit main body. A length of the cross flow fan in a rotational axis direction is longer than a length of the air outlet in a longitudinal direction such that the cross flow fan extends beyond both ends of the air outlet in the longitudinal direction and the rotational axis direction of the cross flow fan matches the left-right direction of the indoor unit main body.

The air-conditioning apparatus also includes deflectors provided in the indoor unit main body. The deflectors oppose airflows blown from fan extensions, which are portions of the cross flow fan and positioned beyond the both ends of the air outlet in the longitudinal direction.

In the air-conditioning apparatus, the cross flow fan includes an individual impeller unit that has a plurality of blades provided in a circumferential direction of annular support plates.

In the air-conditioning apparatus, first blades opposing the air outlet and second blades in the extensions opposing the deflectors are disposed between the support plates neighboring each other, the second blades being differently shaped from the first blades, and an airflow blown through the second blades in the extensions flows at a lower wind speed than an airflow blown through the first blades opposing the air outlet.

According to the present invention, the stagnation pressure higher than the atmospheric pressure can be generated near each end of the air outlet by causing the outlet airflow from the fan extension of the cross flow fan to impinge upon a corresponding one of the deflectors. Thus, reverse suction, in which the indoor air flows from the outside of the indoor unit into the indoor unit through the air outlet, can be prevented. Accordingly, degradation of the performance of the fan, an increase in noise, scattering of water droplets, and the like, which are caused by generation of reverse suction, can be prevented. Furthermore, the wind speed of the airflows blown from portions, which oppose the respective deflectors in the rotational axis direction of the fan, is set to be lower than the wind speed of the airflow blown from a portion opposing the air outlet. Thus, reverse suction is prevented while a large air volume of the entire fan is maintained, and accordingly, power consumption and noise can be reduced.

BRIEF DESCRIPTION OF DRAWINGS

FIG. 3 (*a*) that illustrates a side view of the cross flow fan, and FIG. 3 (*b*) that illustrates a sectional view of the cross flow fan taken along line U-U in FIG. 3 (*a*).

DETAILED DESCRIPTION

Embodiment 1

Figure 1:
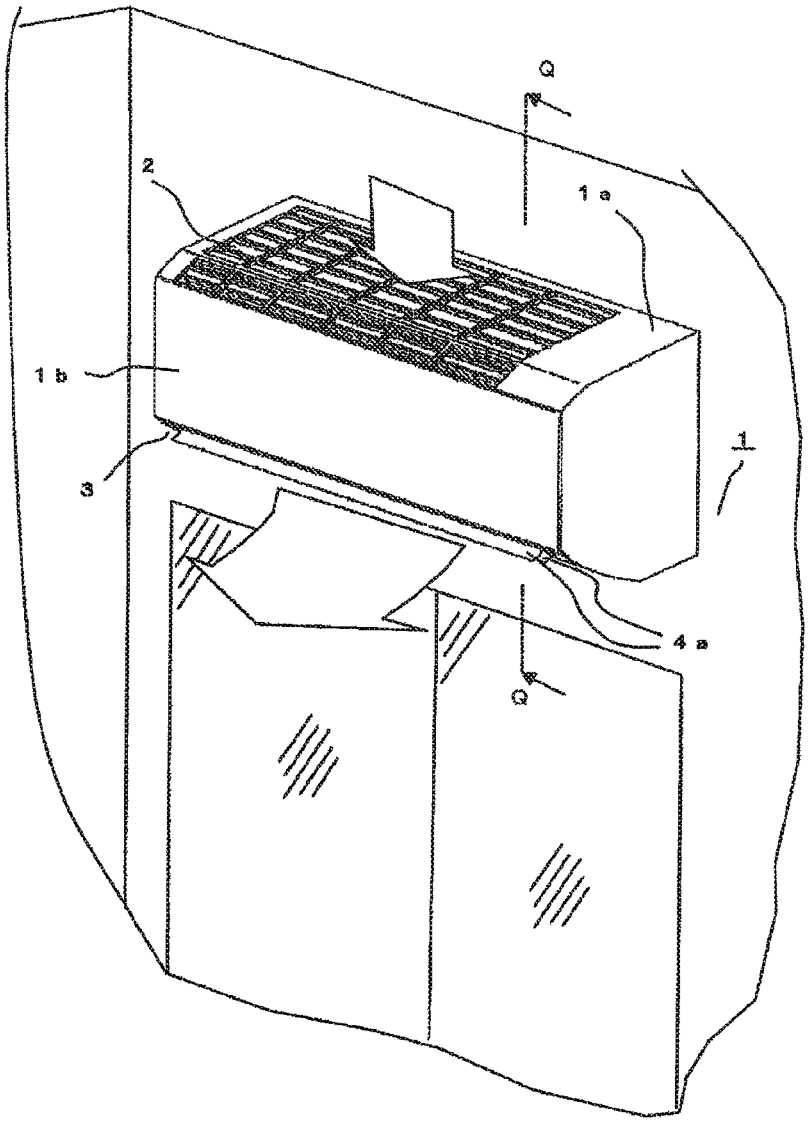
FIG. 1 is an external perspective view illustrating an indoor unit of an air-conditioning apparatus equipped with a cross flow fan according to Embodiment 1.
Figure 2:
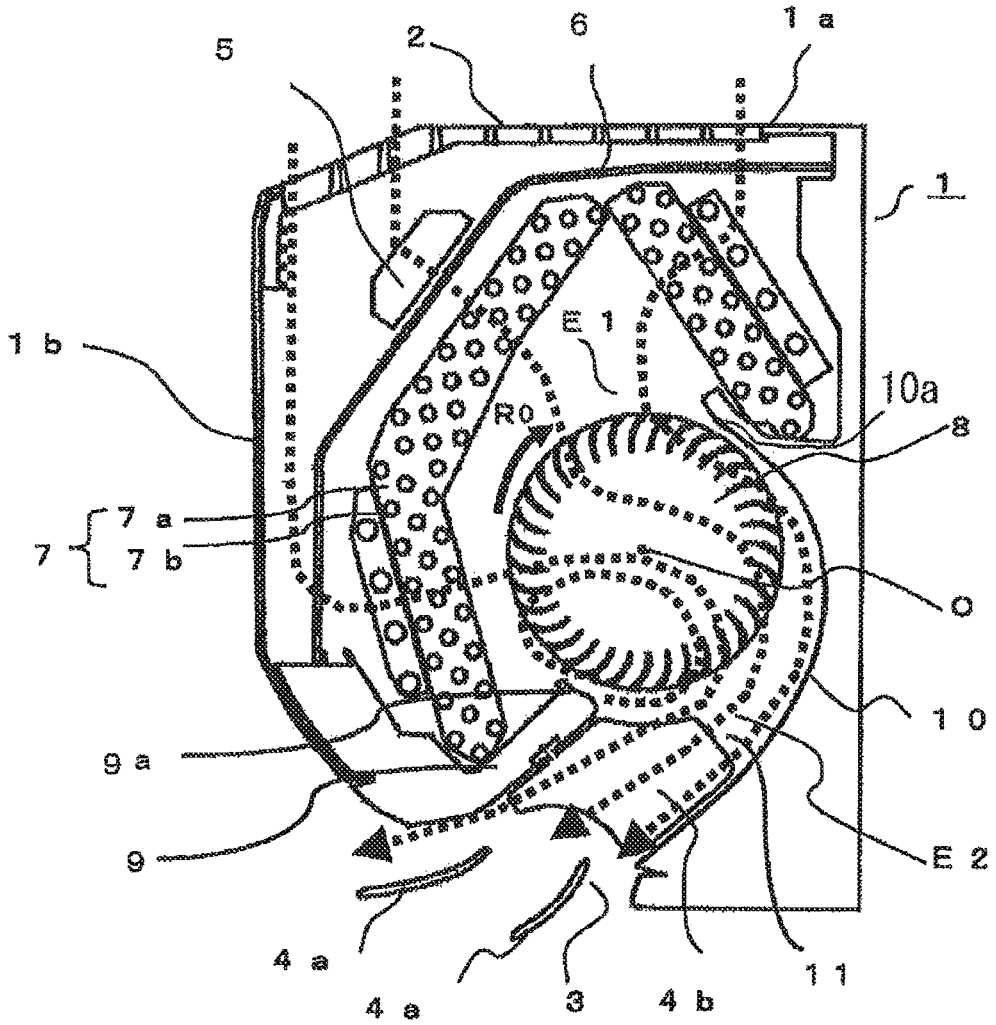
FIG. 2 is a longitudinal sectional view of the indoor unit according to Embodiment 1 taken along line Q-Q in FIG. 1.

Embodiment 1 of the present invention will be described below with reference to the drawings. FIG. 1 is an external perspective view illustrating an indoor unit 1 of an air-conditioning apparatus equipped with a cross flow fan 8 according to Embodiment 1. FIG. 2 is a longitudinal sectional view of the indoor unit 1 illustrated in FIG. 1 taken along line Q-Q in FIG. 1. Airflows are indicated by hollow arrows in FIG. 1 and dotted arrows in FIG. 2. In the air-conditioning apparatus, a refrigeration cycle is actually formed by an indoor unit and an outdoor unit. However, since description herein relates to the structure of the indoor unit, description relating to the outdoor unit is omitted. As illustrated in FIGS. 1 and 2, the indoor unit 1 of the air-conditioning apparatus (hereafter, simply referred to as the "indoor unit") has a substantially elongated box shape extending in the left-right direction and is installed on a wall of a room. An air inlet grille 2, an electrical dust collecting unit 5, and a filter 6 are disposed in an upper portion 1*a* of an indoor unit 1 main body. The air inlet grille 2 serves as an air inlet, through which indoor air is sucked. The electrical dust collecting unit 5 collects dust by charging the dust with static electricity. The mesh-shaped filter 6 removes dust. A heat exchanger 7 is disposed on the front surface side and upper side of the cross flow fan 8 so as to surround the cross flow fan 8. The heat exchanger 7 includes a plurality of aluminum fins 7*a* disposed parallel to one another and pipes 7*b* that extend through the aluminum fins 7*a*. Furthermore, a front surface 1*b* of the indoor unit 1 main body is covered with a front surface panel, and an air outlet 3 is provided in a lower portion of the indoor unit 1 main body. Indoor air having undergone heat exchange in the heat exchanger 7 is blown into the room through the air outlet 3. The air outlet 3 is defined by an elongated opening that extends in the longitudinal direction, which is the left-right direction of the indoor unit 1 main body. That is, the longitudinal direction of the air outlet 3 coincides with the left-right direction of the indoor unit 1 main body. The cross flow fan 8 serving as an air sending device is provided between the heat exchanger 7 and the air outlet 3 such that the rotational axis direction of the cross flow fan 8 extends in the left-right direction (longitudinal direction) of the indoor unit 1 main body. The cross flow fan 8 is rotated by a motor 16 so as to cause indoor air to flow from the air inlet grille 2 to the air outlet 3. The indoor unit 1 main body also includes a stabilizer 9 and a rear guide 10 therein, which separate an air inlet region E1 and an air outlet region E2 from each other with respect to the cross flow fan 8. The rear guide 10 has, for example, a vortex shape and defines a rear surface of an outlet air path 11. Up-down and left-right wind guide vanes 4*a* and 4*b* are rotatably attached to the air outlet 3 so as to change the direction of the air flowing into the room. In the drawings, O denotes the rotational center of the cross flow fan 8, E1 denotes the air inlet region of the fan 8, and E2 denotes the air outlet region, which is defined at a position opposite to the air inlet region E1 with respect to the rotational center O. The air inlet region E1 and air outlet region E2 of the cross flow fan 8 are separated from each other by a tongue portion 9*a* of the stabilizer 9 and an upstream end portion 10*a* of the rear guide 10, the upstream end portion 10*a* being on the upstream side with respect to an airflow. RO denotes the rotational direction of the cross flow fan 8.

Figure 3:
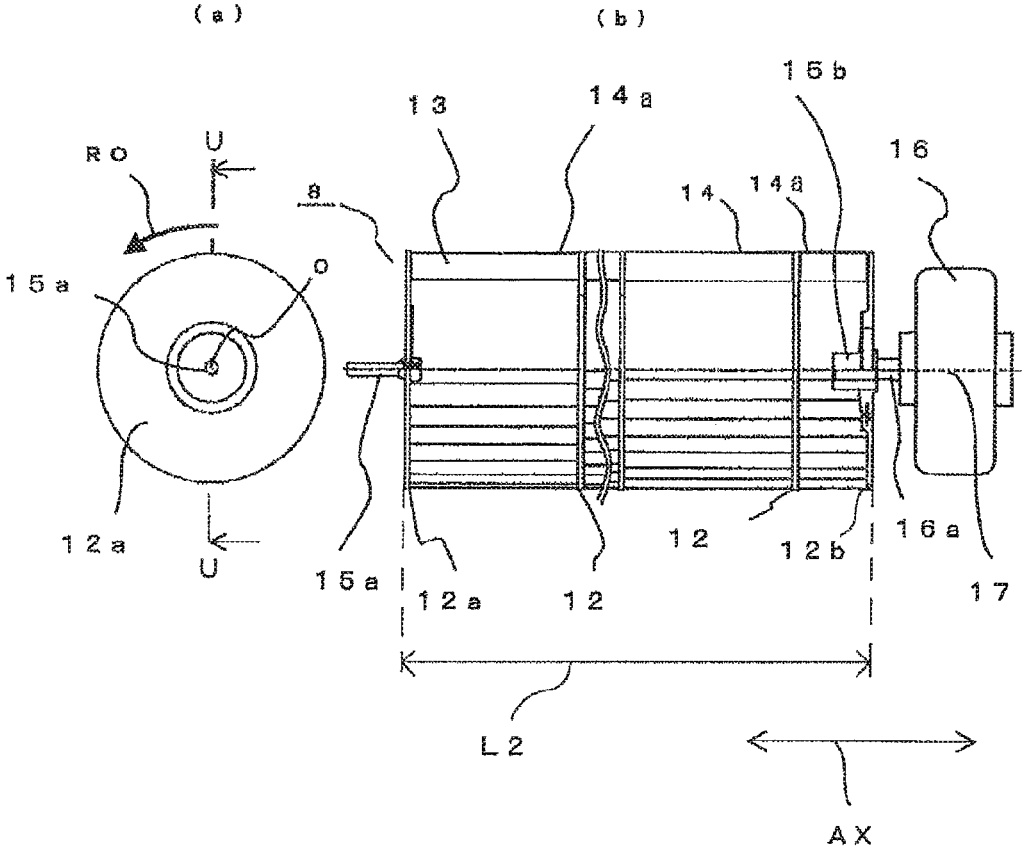
FIG. 3 includes the following schematic views of the cross flow fan according to Embodiment 1.
Figure 4:
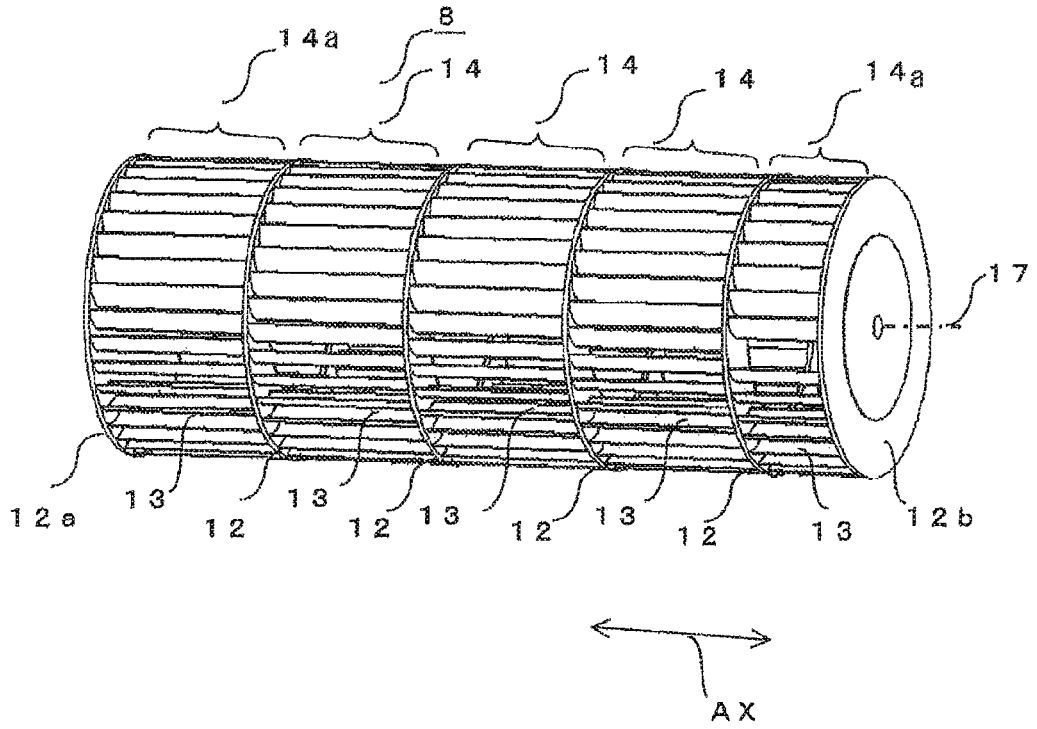
FIG. 4 (*a*) is an enlarged perspective view of the cross flow fan, in which five individual impeller units (units) according to Embodiment 1 are secured in a rotational axis direction, and FIG. 4 (*b*) is an explanatory view illustrating a support plate.
Figure 4:
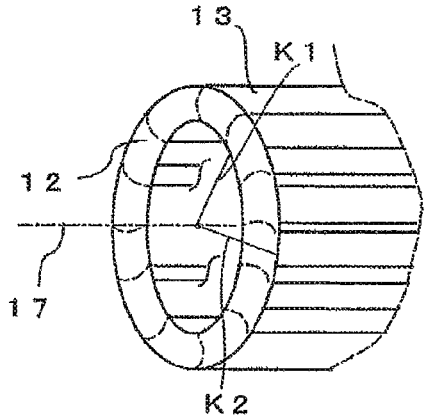

FIG. 3 includes schematic views of the cross flow fan 8 according to Embodiment 1. FIG. 3 (*a*) is a side view of the cross flow fan, and FIG. 3 (*b*) is a sectional view of the cross flow fan taken along line U-U in FIG. 3 (*a*). In the lower half of FIG. 3 (*b*), a plurality of blades on the rear side of the page can be seen, and in the upper half of FIG. 3 (*b*), one of the blades 13 is illustrated. FIG. 4 (*a*) is an enlarged perspective view of the cross flow fan 8, in which five individual impeller units 14 according to Embodiment 1 are secured in a rotational axis direction AX. FIG. 4 (*b*) is an explanatory view illustrating a support plate 12. In FIG. 4, an impeller portion is illustrated as the cross flow fan 8 with the motor 16 and a motor shaft 16*a* omitted. The number of the individual impeller units 14 of the cross flow fan 8 and the number of blades 13 of the individual impeller unit 14 are not limited to the above-described numbers. Any numbers of the individual impeller units 14 and the blades of the individual impeller unit 14 may be used.

As illustrated in FIGS. 3 and 4, the cross flow fan 8 includes a plurality of, for example, five individual impeller units 14 in the rotational axis direction AX (longitudinal direction). The support plate 12 having an annular shape is disposed at one end of each individual impeller unit 14. The plurality of blades 13 that extend in the rotational axis direction AX are disposed along the outer circumference of each support plate 12. The plurality of individual impeller units 14, which are each formed of, for example, a thermoplastic resin such as AS resin or ABS resin, is provided in the rotational axis direction AX that passes through the centers of the support plates 12. Side ends of the blades 13 are connected to the support plates 12 of the neighboring individual impeller units 14 by, for example, ultrasonic welding. An end plate 12*b*, which is positioned at the other end, includes only a disc without the blades 13. A support plate 12*a* positioned at the one end in the rotational axis direction AX has a fan shaft 15*a* at its center, and the end plate 12*b* positioned at the other end has a fan boss 15*b* at its center. The fan boss 15*b* is secured to the motor shaft 16*a* of the motor 16 with a screw or the like. That is, the support plate 12*a* and the end plate 12*b* positioned at the respective ends of the cross flow fan 8 in the rotational axis direction AX each have a disc shape and respectively have the fan shaft 15*a* and the fan boss 15*b* at respective central portions where a rotational axis 17 is positioned. The support plates 12 except for those at the both ends each have an annular shape having a space at its central portion. The rotational axis 17, which is the rotational center, is positioned in the space formed in each of these support plates 12, and an inner diameter K1 and an outer diameter K2 of the support plate 12 are defined as illustrated in FIG. 4 (*b*). Here, in FIG. 3 (*b*) and FIG. 4 (*b*), the dotted chain line indicates a virtual rotational axis that connects the motor shaft 16*a* and the fan shaft 15*a* to each other and indicates rotational center O. Here, the virtual rotational axis is the rotational axis 17 and a direction in which the rotational axis 17 extends is the rotational axis direction AX. Furthermore, one individual impeller unit is referred to as a unit 14 and the units positioned at end portions in the rotational axis direction AX are referred to as end units 14*a*.

Figure 5:
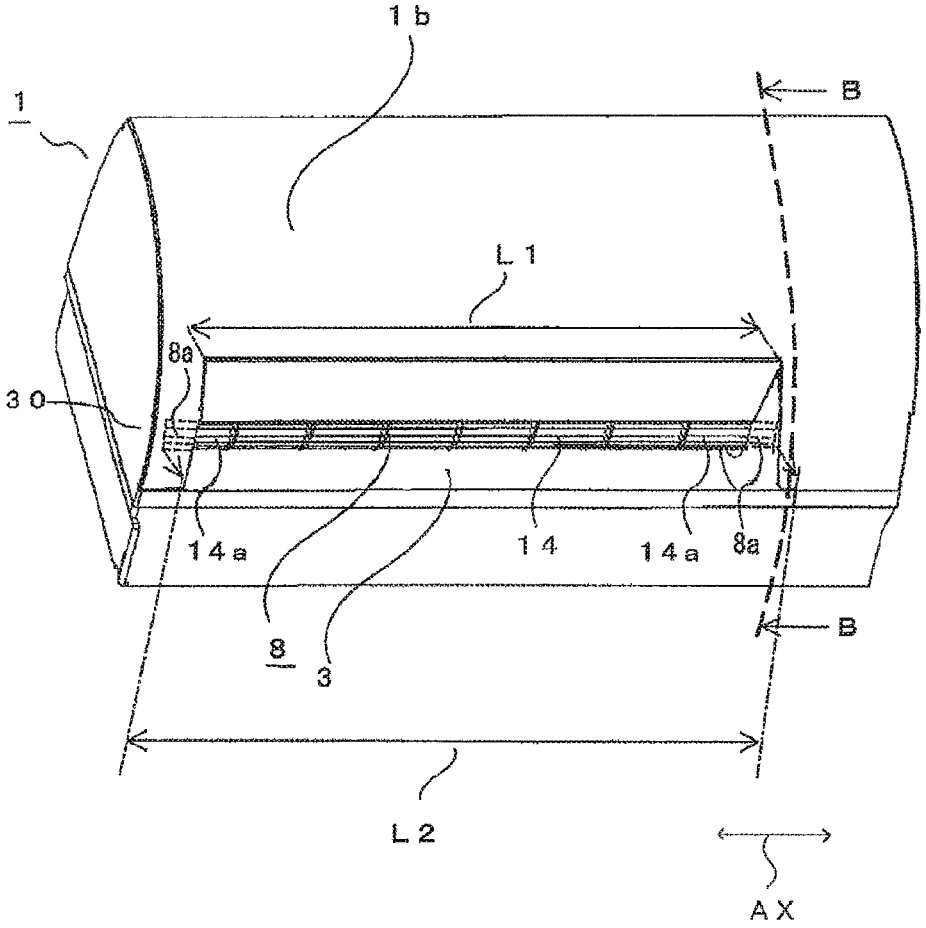
FIG. 5 is a perspective view of the indoor unit of the air-conditioning apparatus according to Embodiment 1 seen from obliquely below.
Figure 6:
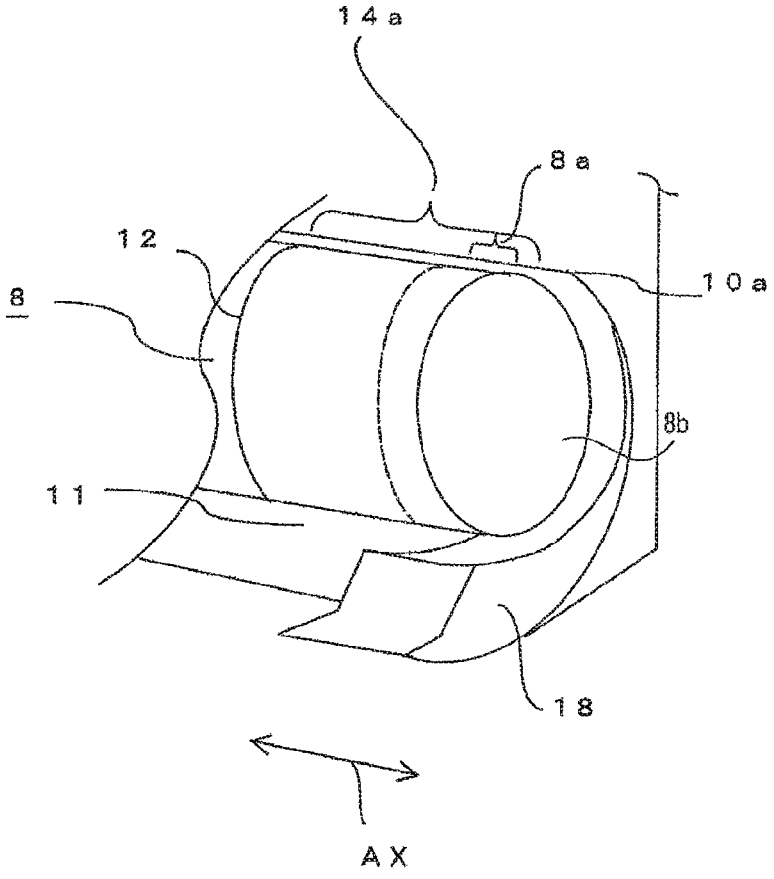
FIG. 6 is a perspective view of a deflector according to Embodiment 1.
Figure 7:
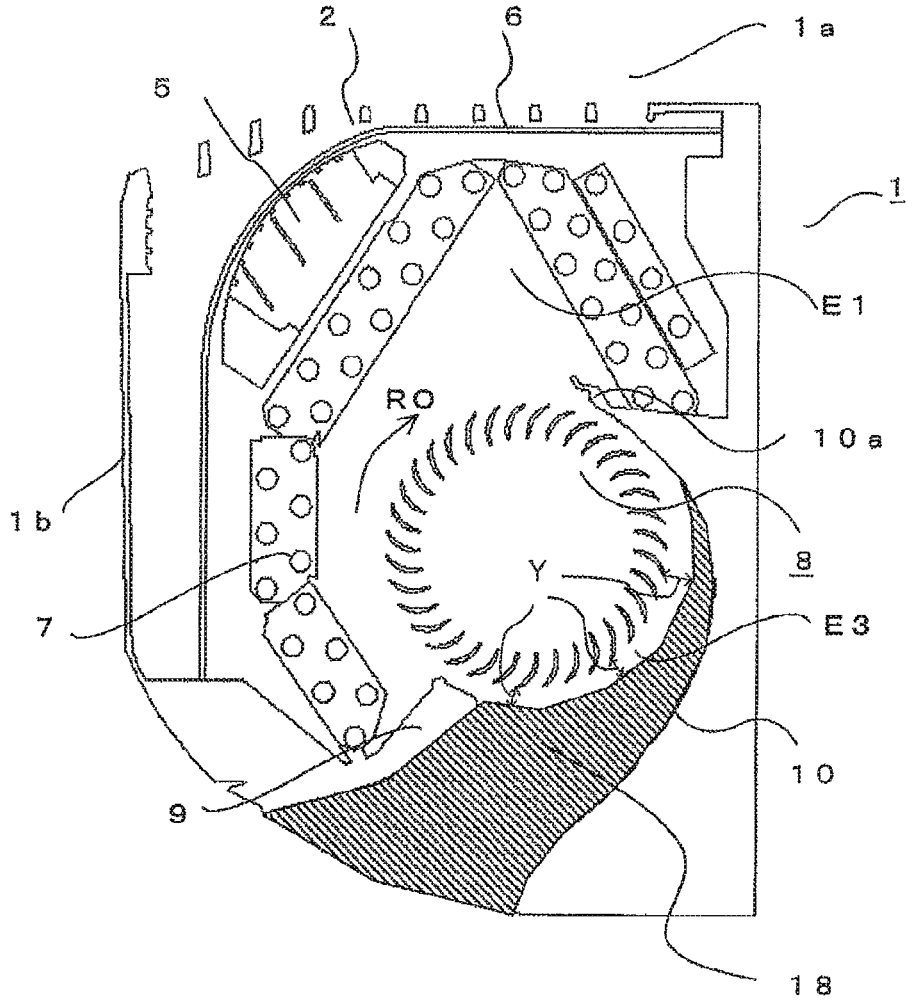
FIG. 7 is a sectional view of the indoor unit according to Embodiment 1 taken along line B-B in FIG. 5.

FIG. 5 is a perspective view of the indoor unit 1 main body of the air-conditioning apparatus according to Embodiment 1 seen from obliquely below. The up-down and left-right wind guide vanes 4*a* and 4*b* are omitted from FIG. 5, and part of the cross flow fan 8 is seen through the air outlet 3. In comparison with a length L1 of the air outlet 3 of the indoor unit in the longitudinal direction, a length L2 of the cross flow fan 8 in the rotational axis direction AX is long (L2>L1). The longitudinal direction of the air outlet 3 coincides with the left-right direction of the indoor unit 1 main body. Part of each end unit 14*a* of the cross flow fan 8 extends beyond a corresponding one of the ends of the air outlet 3. This extension, that is, a portion of the end unit 14*a* located at each end of the cross flow fan 8 and not facing the air outlet 3 is referred to as a fan extension 8*a*. That is, the left and right end portions of the cross flow fan 8 extend outward beyond the respective ends of the air outlet 3 in the longitudinal direction. These portions of the cross flow fan 8 that extend beyond the air outlet 3 define the fan extensions 8*a*. Deflectors 18 are provided at positions opposite the fan extensions 8*a* in the indoor unit 1 main body. Outlet airflows blown from the fan extensions 8*a* impinge upon the deflectors 18. FIG. 6 is a perspective view of the deflector 18 according to Embodiment 1, illustrating the relationships among the fan extension 8*a*, the deflector 18, and the outlet air path 11. FIG. 7 is a sectional view taken along line B-B in FIG. 5, illustrating a longitudinal section of a portion of the indoor unit 1 of the air-conditioning apparatus including the deflector 18. The shaded portion in FIG. 7 indicates the deflector 18.

The rear surface of the outlet air path 11 opposite the fan extension 8*a* provided at each end of the fan 8 in the rotational axis direction AX is defined by the upstream side of the rear guide 10 up to an intermediate position thereof, and, as illustrated in FIG. 7, is defined by the deflectors 18 from the intermediate position thereof, and then by the stabilizer 9 without being connected to an opening such as the air outlet 3. In the outlet air path 11, the distance between the outer circumference of the impeller of the cross flow fan 8 and the deflector 18 is, as indicated by the sign Y in FIG. 7, substantially uniform from the most upstream side 10*a* of the rear guide 10 to a portion continuous with the stabilizer 9. Impinging regions where outlet airflows blown from the fan extensions 8*a* impinge upon the deflectors 18 are defined as regions E3. That is, out of the air outlet region E2 (see FIG. 8), toward which airflow is blown from the cross flow fan 8, regions toward which the air is blown from the fan extensions 8*a* are the impinging regions E3. The distance Y between the outer circumferences of the fan extensions 8*a* and the surfaces of the deflectors 18 is, for example, about 10 mm.

In a portion of the cross flow fan 8 except for the fan extensions 8*a* in the rotational axis direction AX, that is, a central portion of the fan 8 in the rotational axis direction AX, the rear surface of the outlet air path 11 is, as illustrated in FIG. 2, defined by the rear guide 10 up to the air outlet 3 and has a vortex shape from the most upstream end side 10*a* of the rear guide 10 to the air outlet 3. The distance between the outer circumference of the impeller of the cross flow fan 8 and the rear guide 10 is gradually increasing.

Figure 8:
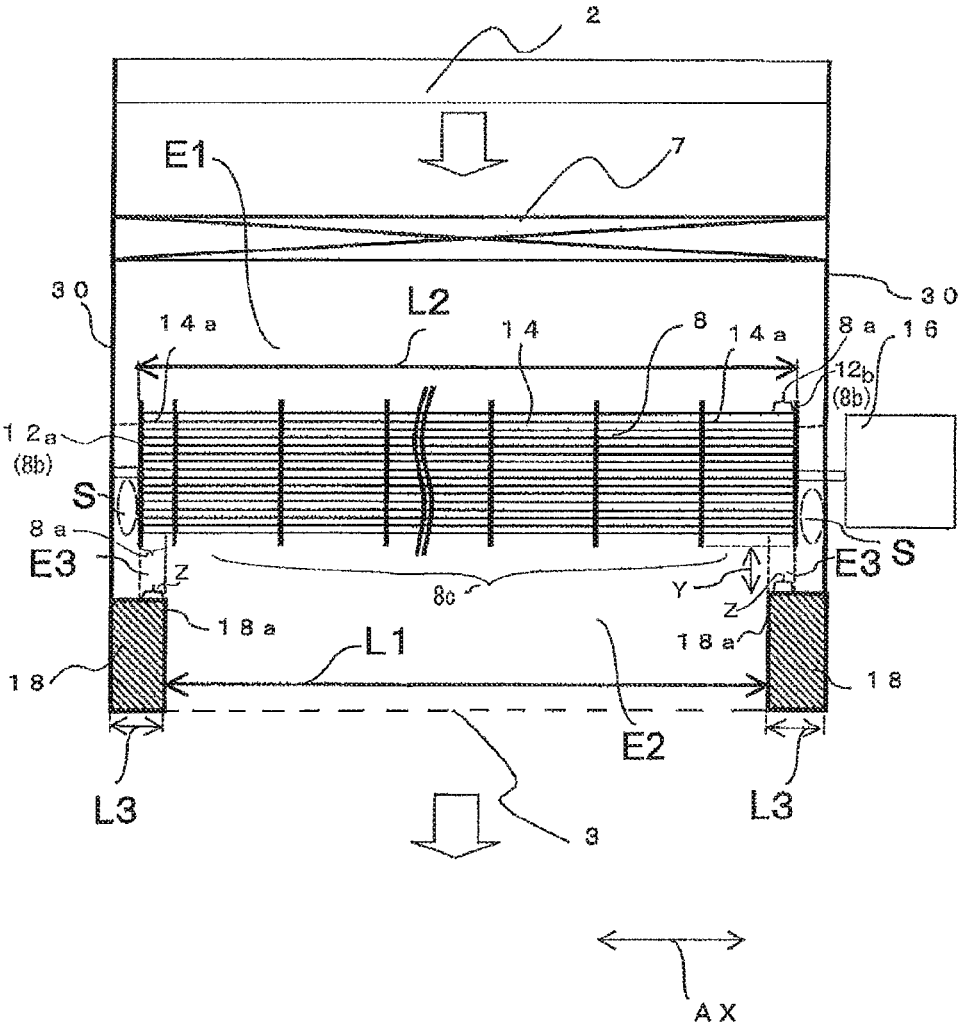
FIG. 8 is a simplified schematic view of an inner structure of the indoor unit according to Embodiment 1.
Figure 9:
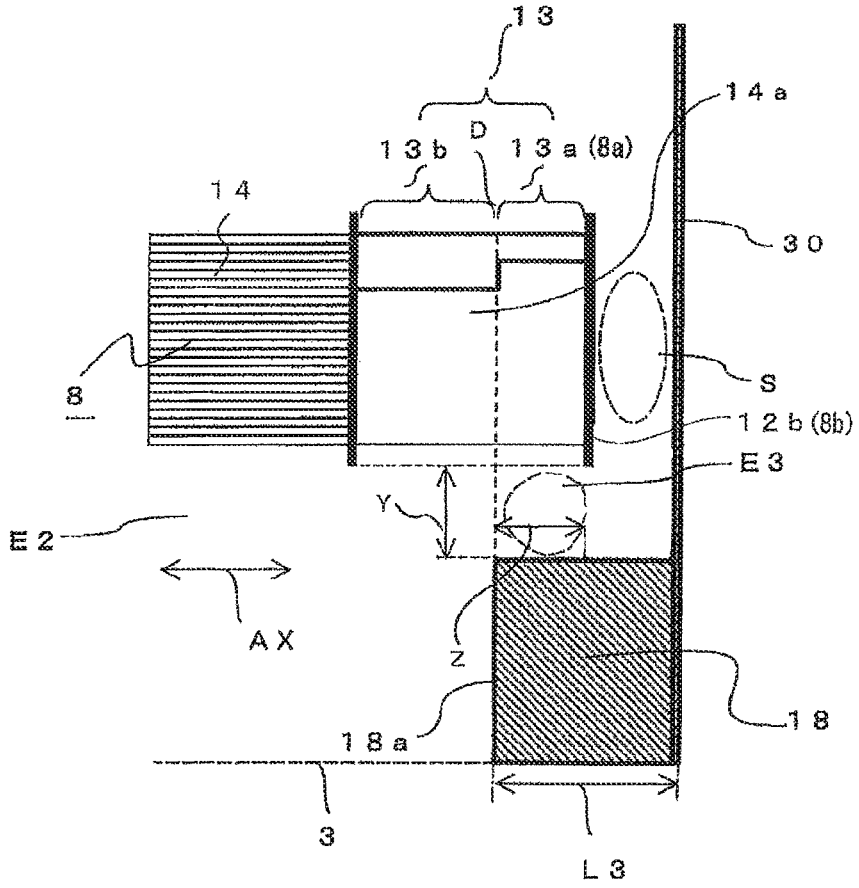
FIG. 9 is an enlarged schematic view of a blade of an end unit of the cross flow fan according to Embodiment 1.

FIG. 8 is a simplified schematic view of an internal structure of the indoor unit 1 according to Embodiment 1, simply illustrating the relationships among the air inlet grille 2, the heat exchanger 7, the cross flow fan 8, and the air outlet 3 in the airflow direction (hollow arrows). FIG. 9 is an enlarged schematic view of one of the blades 13 of one of the end units 14*a* of the cross flow fan 8 according to Embodiment 1. The other end unit 14*a* of the fan 8 in the rotational axis direction AX is similar to that illustrated in FIG. 9. The cross flow fan 8 includes the fan extensions 8*a* at both end portions in the rotational axis direction AX. These fan extensions 8*a* oppose the respective deflectors 18 in the air outlet region E2. Portions of the air outlet region E2 opposite the deflectors 18 is referred to as the impinging regions E3. The portion of the cross flow fan 8 except for the fan extensions 8*a* in the rotational axis direction AX, that is, the central portion of the cross flow fan 8 in the rotational axis direction AX opposes the air outlet 3 defined by an opening in the air outlet region E2. Here, the positions of the both end plates 12*a* and 12*b* are referred to as fan end surfaces 8*b* and the central portion of the cross flow fan 8 in the rotational axis direction AX opposing the air outlet 3 is referred to as a fan central portion 8*c*. Side walls 30 define both side surfaces of an air passage from the air inlet grille 2 in the indoor unit 1 to the air outlet 3.

Examples of the lengths of the fans used in Embodiment 1 are as follows.

That is, the outer diameter K2 and the inner diameter K1 of the annular support plate 12 secured to the blades 13 at the end portion of each individual impeller unit 14 are respectively ϕ110 mm and ϕ60 mm, and a plurality of, for example, 35 blades 13 are secured at the circumference of each support plate 12. In the rotational axis direction AX, for example, a length L1 of the air outlet 3 in the longitudinal direction is, 610 mm, an entire length L2 of the cross flow fan 8 in the rotational axis direction AX is 640 mm, and a specified width L3 of each deflector 18 in the rotational axis direction AX is 30 mm. Each deflector 18 is superposed with a corresponding one of the fan extensions 8*a* by, for example, about a half the length L3 thereof in the rotational axis direction AX, and a length Z of the fan extension 8*a* in the rotational axis direction AX is, for example, about 15 mm. Spaces formed between the end plates 12*a* and 12*b* at the both ends of the fan 8 and the respective side walls 30 are denoted by S. The length of the space S in the rotational axis direction AX is, for example, 15 mm. The length of each end unit 14*a* in the rotational axis direction AX is from 25 to 70 mm, and the length of each of the units 14 other than two end units 14*a* in the rotational axis direction AX is about 80 mm.

As illustrated in FIG. 9, in each end unit 14*a* of the cross flow fan 8, blades 13*a* of the fan extension 8*a* that oppose the deflector 18 have a shape different from that of the blades of another portion. That is, the sectional blade shape of the blade 13*a* perpendicular to the rotational axis 17 of the end unit 14*a*, the blade 13*a* being a portion of the blade opposing the deflector 18, is different from that of a blade 13*b*, which is a portion of the blade not opposing the deflectors 18, that is, opposing the air outlet 3.

The difference in blade sectional shape between the blade 13*a*, which opposes the fan extension 8*a*, that is, the deflector 18, and the blade 13*b*, which opposes the air outlet 3, is described. Here, the blades 13*a*, which opposes the deflector 18 in the rotational axis direction AX, is referred to as a deflector opposing blade portion 13*a*, and the blade 13*b*, which opposes the air outlet 3 (in other words, the blade in a portion not opposing the deflector 18) is referred to as an air outlet opposing blade portion 13*b*.

Figure 10:
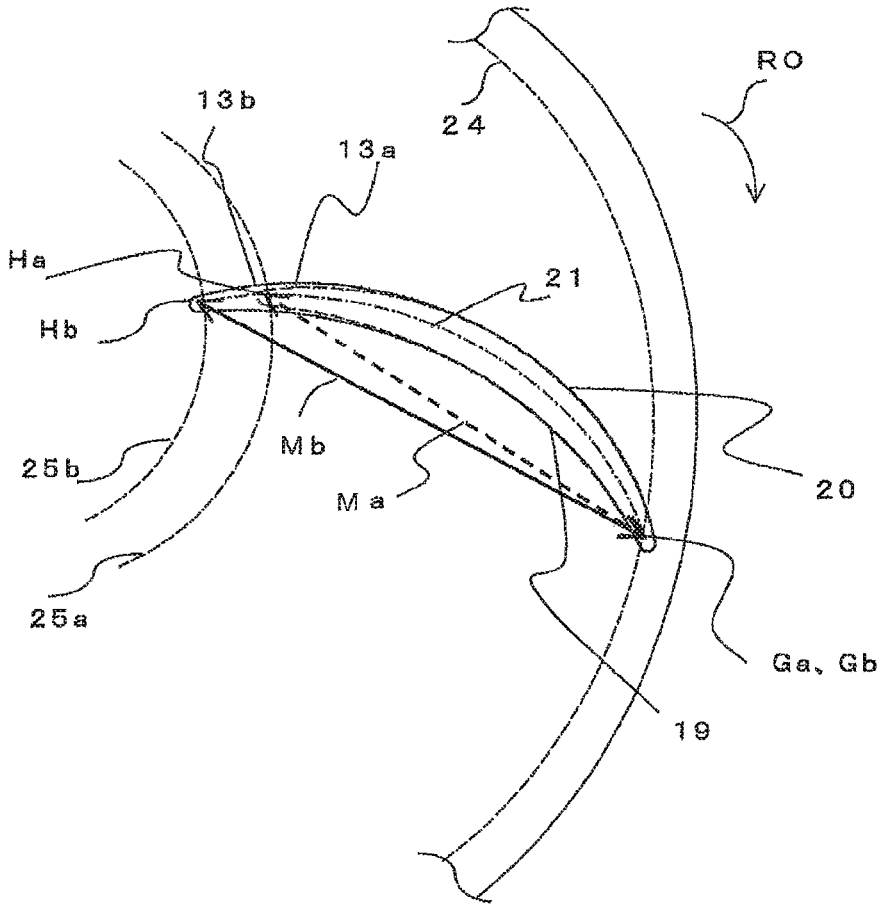
FIG. 10 is an explanatory view, in which blade sections of an air outlet opposing blade portion and a deflector opposing blade portion in the end unit of the cross flow fan according to Embodiment 1 are superposed with each other.

FIG. 10 is an explanatory view illustrating a section perpendicular to the rotational axis 17, in which the blade sections of the deflector opposing blade portion 13*a* and the air outlet opposing blade portion 13*b* in the cross flow fan 8 according to Embodiment 1 are superposed with each other. The blades 13*a* and 13*b* each have a surface facing the rotational direction RO (referred to as a positive pressure surface 19) and a surface facing a direction opposite to the rotational direction (referred to as a negative pressure surface 20). A camber line 21 (indicated by the dotted chain line) of the blade, which extends in the center between the positive pressure surface 19 and the negative pressure surface 20, has a substantially arc shape. In the deflector opposing blade portion 13*a* and the air outlet opposing blade portion 13*b*, an inner circumferential blade end portion and an outer circumferential blade end portion have respective arc shapes. Thus, inner circumferential blade end portions Ha and Hb and outer circumferential blade end portions Ga and Gb are defined as the centers of curvature of these arc shapes, a camber line 21*a* of the deflector opposing blade portion 13*a* is an arc connecting the inner circumferential blade end portion Ha and the outer circumferential blade end portion Ga to each other and a camber line 21*b* of the air outlet opposing blade portion 13*b* is an arc connecting the inner circumferential blade end portion Hb and the outer circumferential blade end portion Gb to each other. Here, the index a indicates portions of the deflector opposing blade portion 13*a* and the index b indicates portions of the air outlet opposing blade portion 13*b*.

A straight line that connects the inner circumferential blade end portion Ha and the outer circumferential blade end portion Ga to each other is referred to as a chord line Ma, and a straight line that connects the inner circumferential blade end portion Hb and the outer circumferential blade end portion Gb to each other is referred to as a chord line Mb. Here, the length of the chord line Ma of the deflector opposing blade portion 13*a* is set to be shorter than the length of the chord line Mb of the air outlet opposing blade portion 13*b* in Embodiment 1. For example, the length of the chord line Ma is set to 13 to 14 mm, the length of the chord line Mb is set to 15 to 16 mm, and the length of the chord line Ma is set to shorter than that of the chord line Mb by 2 to 3 mm. Here, the locus of rotation of the outer circumferential blade end portion Ga, Gb is defined as a blade outer diameter and represented as a blade outer diameter 24. The loci of rotation of the inner circumferential blade end portions Ha and Hb are defined as blade inner diameters and represented as blade inner diameters 25. In Embodiment 1, the outer circumferential blade end portion Ga of the deflector opposing blade portion 13*a* and the outer circumferential blade end portion Gb of the air outlet opposing blade portion 13*b* are, as illustrated in FIG. 10, set at the same position, and the blade outer diameter 24 passes through the outer circumferential blade end portion Ga, Gb. A blade inner diameter 25*a* that passes through the inner circumferential blade end portion Ha of the deflector opposing blade portion 13*a* is larger than a blade inner diameter 25*b* that passes through the inner circumferential blade end portion Hb of the air outlet opposing blade portion 13*b*. Thus, the blade inner diameter 25*a* is located outside the blade inner diameter 25*b*.

Figure 11:
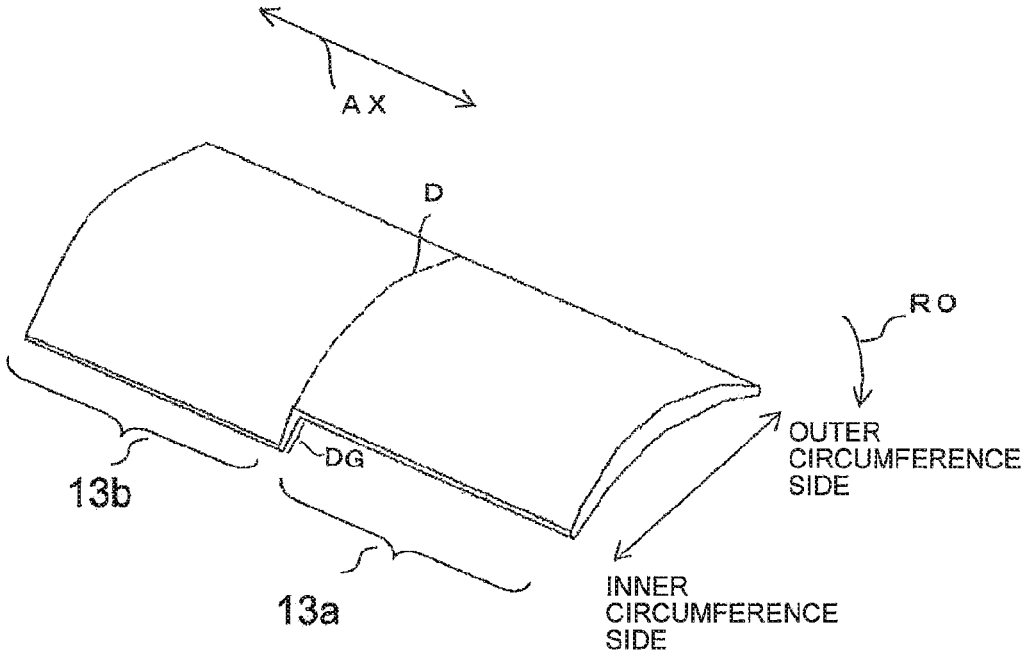
FIG. 11 is a perspective view of one of the blades of the end unit of the cross flow fan according to Embodiment 1.

FIG. 11 is a perspective view of one of the blades 13 of the end unit 14*a* of the cross flow fan 8 according to Embodiment 1. The blade shapes of the deflector opposing blade portion 13*a* and the air outlet opposing blade portion 13*b* are different from each other. The deflector opposing blade portion 13*a* has the short chord line Ma and the air outlet opposing blade portion 13*b* has the long chord line Mb. In FIG. 11, D denotes a boundary portion between the deflector opposing blade portion 13*a* and the air outlet opposing blade portion 13*b*, and DG denotes a step formed by the difference between the lengths of the chord lines Ma and Mb. The units 14 positioned inside the end units 14*a* in the rotational axis direction AX in the structure, for example, illustrated in FIG. 4 (*a*), the blade shape of the units 14, that is, three central units 14 other than the end units 14*a*, are uniform and the same as that of the air outlet opposing blade portion 13*b*.

Figure 12:
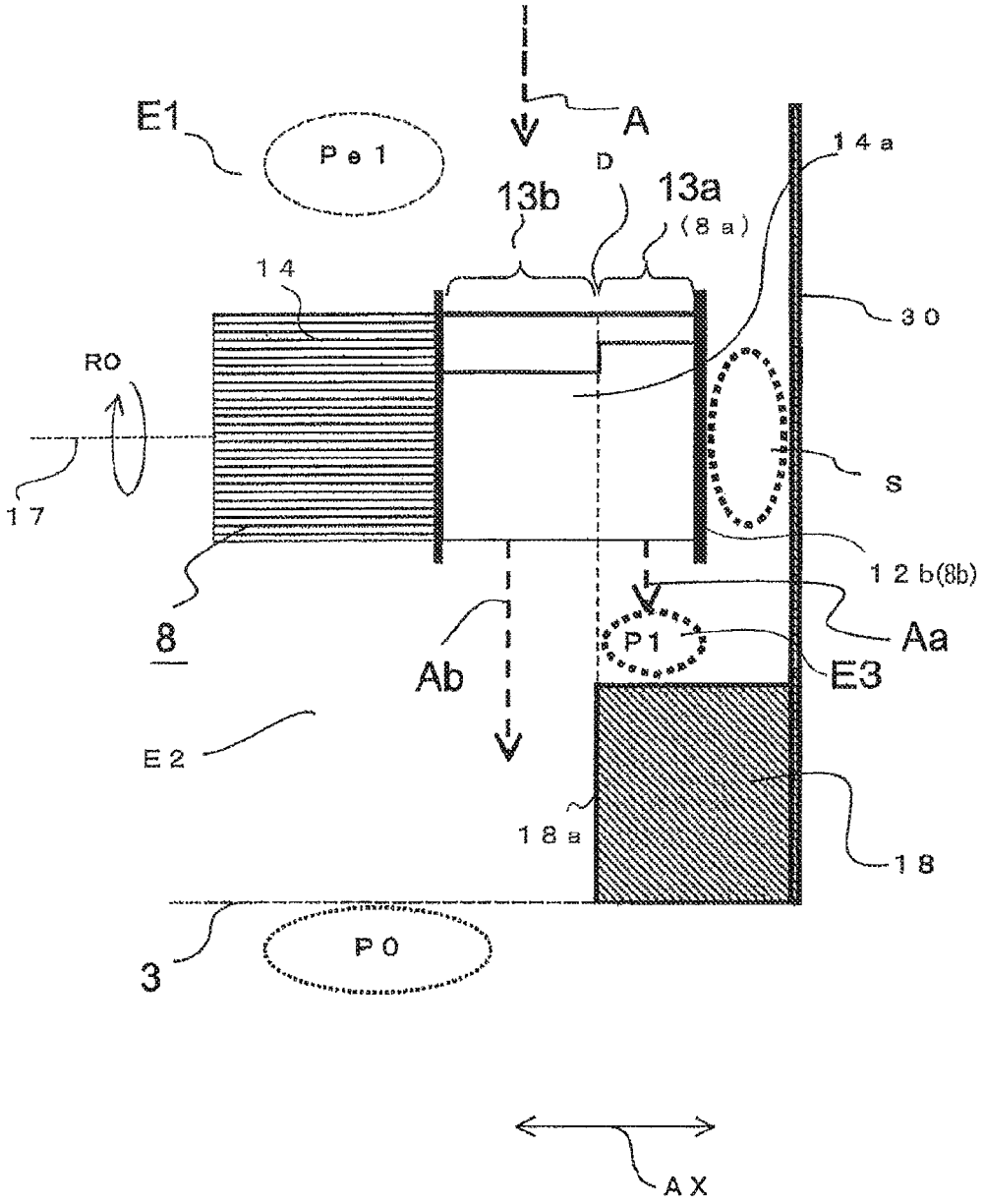
FIG. 12 is an enlarged explanatory view of the blade of the end unit of the cross flow fan and a region around the blade according to Embodiment 1.

Operation of the blade according to Embodiment 1 is described below with reference to FIG. 12. Similarly to FIG. 9, FIG. 12 is an enlarged explanatory view illustrating the blade 13 of the end unit 14*a* according to Embodiment 1 and a region around the blade 13. The pressure outside the indoor unit 1 main body is the atmospheric pressure P0. When the air-conditioning apparatus is operated, the cross flow fan 8 is rotated by the motor 16. As the cross flow fan 8 is rotated in the RO direction, indoor air is sucked through the air inlet grille 2 provided in the upper portion of the indoor unit 1 main body. When the indoor air passes through the heat exchanger 7, the indoor air is subjected to heat exchange with a refrigerant that flows through the pipes 7*b*. The indoor air having undergone heat exchange with the refrigerant becomes an air-conditioned airflow A, which passes through the cross flow fan 8 and is blown into the room through the air outlet 3. Here, an air pressure Pe1 in the air inlet region E1 when the indoor air flows into the cross flow fan 8 is decreased relative to the atmospheric pressure P0 due to frictional resistance (pressure loss) generated when the indoor air having been sucked through the air inlet grille 2 passes through the heat exchanger 7. The space S, which is continuous with the air inlet region E1, and is in the atmosphere of the same pressure as the air inlet region E1. Thus, the pressure in the space S is equal to that in the air inlet region E1, that is, the air pressure Pe1 (<atmospheric pressure P0). When focusing on the air outlet side of the end unit 14*a*, an airflow Aa, which has been blown out toward a place opposite the deflector 18, impinges upon the deflector 18. Thus, wind speed energy of the airflow Aa is converted into pressure energy, thereby generating a stagnation pressure P1 in the impinging region E3. As the speed at which the cross flow fan 8 is rotated is increased, a wind speed Va of the airflow Aa is increased, thereby the stagnation pressure P1 is increased. When the wind speed Va is equal to or more than a specified value, the stagnation pressure P1 becomes higher than the atmospheric pressure P0. The wind speed Va obtained at the time when the stagnation pressure P1 becomes higher than the atmospheric pressure P0 varies in accordance with the pressure loss in the heat exchanger or the like to be disposed.

The rotation speeds for operation of the cross flow fan 8 disposed in the indoor unit 1 of the air-conditioning apparatus are set in accordance with operational modes such as, weak cooling and strong cooling. The distance Y between the deflector 18 and the outer circumference of the cross flow fan 8, the length Z of the deflector opposing blade portion 13*a* in the rotational axis direction AX, and the length of the chord line Ma of the deflector opposing blade portion 13*a* are determined so that the stagnation pressure P1 can be higher than the atmospheric pressure P0 at the wind speed in operation at the lowest rotation speed. When the deflector opposing blade portion 13*a* and the deflector 18 are provided as described above, during operation of the indoor unit 1, that is, during rotation of the cross flow fan 8, the pressure in the impinging region E3 for the end unit 14*a* of the cross flow fan 8 can be the stagnation pressure P1 (>atmospheric pressure P0). By setting the pressure in the impinging region E3 that communicates with the space S such that the stagnation pressure P1>the atmospheric pressure P0, a pressure difference is generated. Thus, entrance of the indoor air of the atmospheric pressure P0 is prevented by the stagnation pressure P1. Accordingly, reverse suction, in which the indoor air flows from the outside of the indoor unit 1 through the air outlet 3 into the space S, where the pressure is low, inside the indoor unit 1 can be prevented from occurring.

Figure 13:
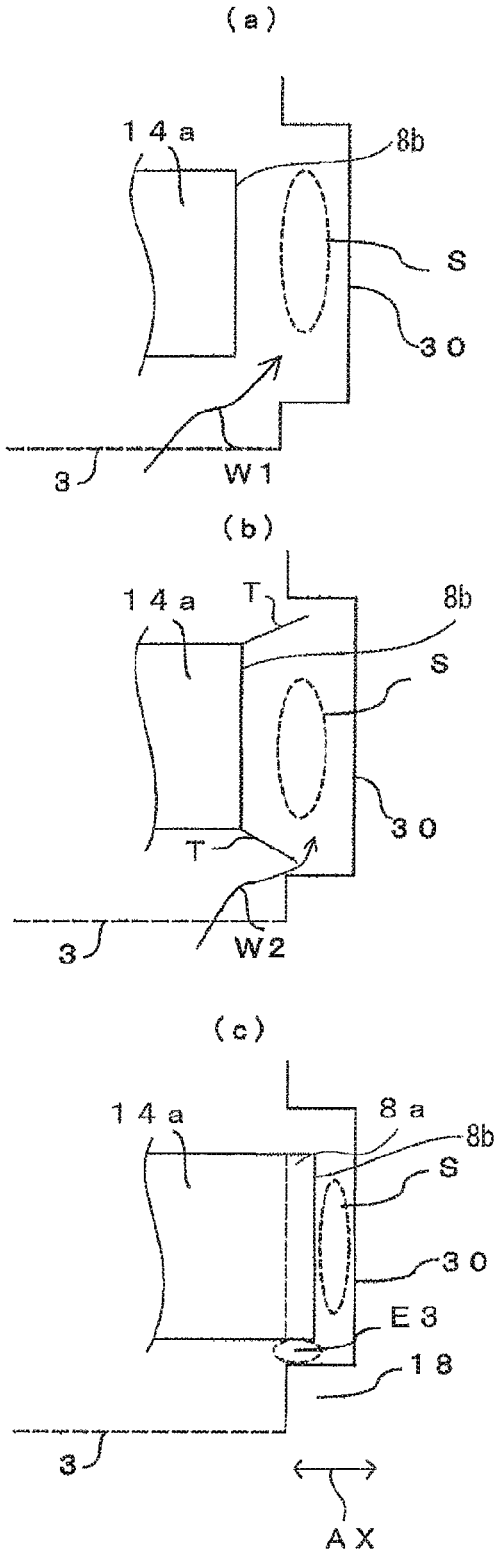
FIG. 13 includes explanatory views illustrating the end unit and a region around the end unit according to Embodiment 1 in comparison with related-art devices.

FIG. 13 includes explanatory views illustrating the end unit 14*a* and a region around the end unit 14*a* of the cross flow fan 8 according to Embodiment 1 in comparison with related-art devices. In any of the cases illustrated in views 13 (*a*) to 13 (*c*), the space S is in an atmosphere in which the pressure is lower than the atmospheric pressure P0 due to frictional resistance (pressure loss) generated when the airflow sucked through the air inlet grille 2 passes through the heat exchanger 7 or the like. As illustrated in FIG. 13 (*a*), in the end unit 14*a* in the rotational axis direction AX, a reverse suction W1, in which air flows from the outside of the indoor unit 1 toward the space S inside the indoor unit 1 through the air outlet 3, is caused by the pressure difference between the pressure in the space S (<atmospheric pressure P0) and the atmospheric pressure P0. In a structure illustrated in FIG. 13 (*b*), a member T, the size of which increases toward the side wall 30 of the indoor unit 1 to form a bell shape, is provided in each end unit 14*a* in the rotational axis direction AX of the fan 8 as described in Patent Literature 1. In this case, in comparison with the case illustrated in FIG. 13 (*a*), although the gap between the end unit 14*a* and the side wall 30 is decreased but not completely eliminated. Also in this case, the atmospheric pressure P0 is higher than the air pressure in the space S, a reverse suction W2, in which air flows from the outside of the indoor unit 1 toward the space S inside the indoor unit 1 through the air outlet 3, is caused similarly to the case illustrated in FIG. 13 (*a*). In contrast, in a structure illustrated in FIG. 13 (*c*) according to Embodiment 1, a superposed portion (fan extension 8*a*), where each end unit 14*a* of the fan and the corresponding one of the deflector 18 oppose and are superposed with each other in the rotational axis direction AX, is provided. This causes the outlet airflow in this portion to impinge upon the deflector 18 so as to generate the stagnation pressure P1, which is higher than the atmospheric pressure P0, in this impinging region E3. That is, the atmosphere of the stagnation pressure P1 that separates the air outlet 3 and the space S from each other is formed between the fan extension 8*a* and the deflector 18. Accordingly, the air is prevented from flowing from the outside of the indoor unit 1 through the air outlet 3 toward the space S inside the indoor unit 1, thereby preventing reverse suction from occurring.

However, with the deflector 18, by causing the outlet airflow to impinge upon the deflector 18, draft resistance is increased. This increases load for the cross flow fan 8, and accordingly, leads to an increase in energy loss and an increase in noise. In contrast, in Embodiment 1, regarding the blade shape of the end unit 14*a* of the cross flow fan 8, each end unit 14*a* has the blade portions 13*a* and 13*b*, the shapes of which are different from each other, and the lengths of the chord lines Ma and Mb are set to be different from each other as illustrated in FIG. 10 here. The length of the chord line Ma of the deflector opposing blade portion 13*a* that opposes the deflector 18 is set to be shorter than the length of the chord line Mb of the air outlet opposing blade portion 13*b*. Thus, an airflow flowing at a low wind speed (small air volume) is obtained by the deflector opposing blade portion 13*a* and an airflow flowing at a high speed (large air volume) is obtained by the air outlet opposing blade portion 13*b*.

Figure 14:
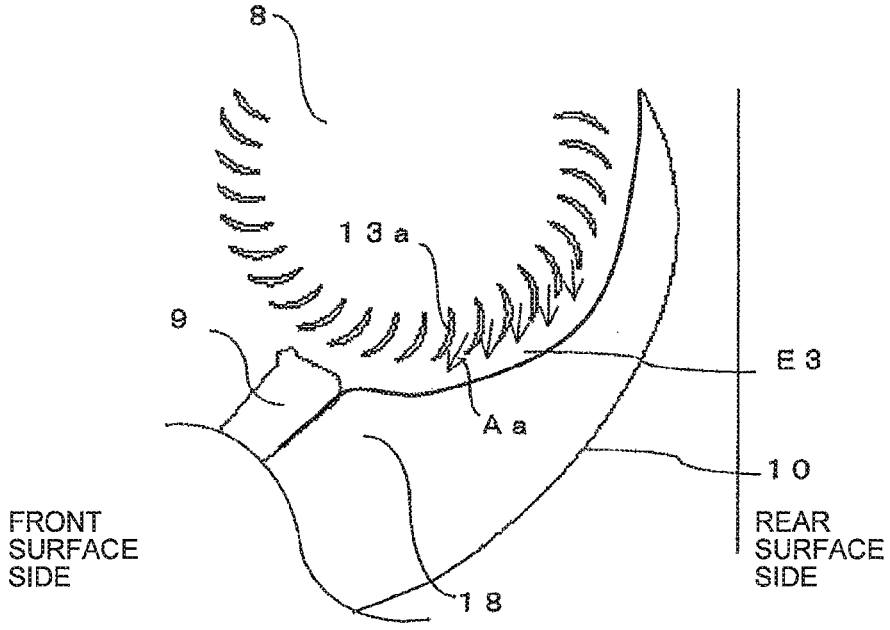
FIG. 14 includes explanatory views illustrating airflows passing between the blades according to Embodiment 1.
Figure 14:
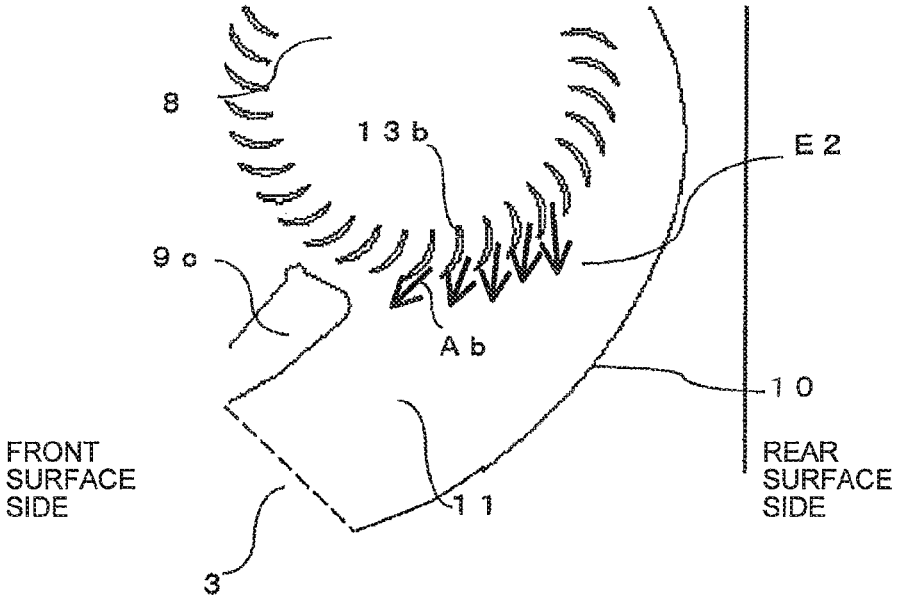

FIG. 14 includes explanatory views of airflows that pass between the blades according to Embodiment 1. FIG. 14 (*a*) illustrates airflows that pass the deflector opposing blade portion 13*a* and FIG. 14 (*b*) illustrates airflows that passes the air outlet opposing blade portion 13*b*. In FIG. 14 (*a*), flows of the airflow Aa impinge upon the deflector 18, thereby generating the stagnation pressure P1, and in FIG. 14 (*b*), flows of an airflow Ab flow through the outlet air path 11 and is blown from the air outlet 3. In the cross flow fan 8, the positive pressure surfaces 19 of the blades 13 press the flows of the airflow, thereby providing energy to the airflow, and the size of the area of the positive pressure surfaces 19 is determined by the length of the chord line M. Thus, the air outlet opposing blade portion 13*b* having the long chord line Mb provides more energy to the airflow Ab than the deflector opposing blade portion 13*a* having the short chord line Ma does, and accordingly, the wind speed Vb is higher than that of the outlet airflow Aa that passes the deflector opposing blade portion 13*a*. That is, wind speed Va of airflow Aa<wind speed Vb of airflow Ab. This turns out to be equivalent to air volume of airflow Aa<air volume of airflow Ab.

When the blades used in the entire length of the cross flow fan 8 in the rotational axis direction AX or in the entire length of the end unit 14*a* are the blades having the short chord line Ma, energy provided to the airflow is not sufficient, and accordingly, a sufficient air volume cannot be obtained from the entirety of the fan. When the blades used in the entire length of the end unit 14*a* are the blades having the long chord line Mb, the impact loss of the airflow that impinges upon the deflectors 18 in the fan extensions 8*a* is increased, thereby increasing the load for the fan. This causes an increase in energy loss and an increase in noise. Regarding the blade shapes according to Embodiment 1, the blade portion 13*a* opposite the deflector 18 has the blade shape in which the chord line is the short chord line Ma so as to provide a minimum energy, at which the stagnation pressure P1 is slightly higher than the atmospheric pressure P0, to the airflow. The blade portion 13*b* not opposing the deflector 18 has the blade shape in which the chord line is the chord line Mb that is longer than the chord line Ma so as to provide much energy to the airflow.

Since the wind speed (air volume) of the airflow Aa obtained by the deflector opposing blade portion 13*a* is lower than that of the airflow Ab, the stagnation pressure P1 higher than the atmospheric pressure P0 is obtained and, at the same time, the energy loss due to the airflow impinging upon the deflector 18 is reduced as much as possible. Furthermore, since the wind speed Va in the impinging region E3 is lower than the wind speed Vb at which the air is directed toward the air outlet 3, in comparison with the case in which the airflow at the wind speed Vb impinges upon the deflector 18, an impact sound is reduced, thereby a low-noise fan is realized. In addition, by setting the wind speed Vb of the airflow Ab obtained by the air outlet opposing blade portion 13*b* to be higher than that of the airflow Aa, a large air volume of the entirety of the fan is maintained. The length of the cross flow fan 8 in the rotational axis direction AX is longer than the length of the air outlet 3 in the longitudinal direction, thereby allowing the speed Vb of the airflow Ab blown from the air outlet 3 over a range from the one end to the other end of the air outlet 3 in the longitudinal direction to be increased. Thus, the occurrence of reverse suction can be further prevented. Even when the stagnation pressure P1 is, for example, only slightly higher than the atmospheric pressure P0, reverse suction that tends to occur at the both end portions of the air outlet 3 can be reliably prevented because of the high speed Vb of the airflow Ab blown from the air outlet 3 over a range from the one end to the other end of the air outlet 3 in the longitudinal direction. By preventing this reverse suction, a scattering of water droplets can be prevented. The scattering of water droplets is a phenomenon in which high-humidity indoor air having flowed into the indoor unit 1 due to reverse suction during cooling operation is condensed through its contact with low-temperature wall surfaces inside the indoor unit 1, and the condensed water then becomes water droplets and scattered into the room. Furthermore, by maintaining a large air volume of the entire fan, the performance of the fan is improved and power consumption can be reduced.

As described above, the air-conditioning apparatus according to Embodiment 1 includes the following components: the air inlet grille 2 that is provided in the upper portion 1*a* of the indoor unit 1 main body of the air-conditioning apparatus, and indoor air is sucked therethrough; the air outlet 3 that is formed in the lower portion of the indoor unit 1 main body of the air-conditioning apparatus so as to be elongated in the left-right direction of the indoor unit 1 main body of the air-conditioning apparatus, and the Indoor air having undergone heat exchange in the heat exchanger 7 is blown into the room therethrough; the cross flow fan 8 that is provided in the indoor unit 1 main body, the length of which in the rotational axis direction AX is longer than the length of the air outlet 3 in the longitudinal direction such that the cross flow fan 8 extends beyond the both ends of the air outlet 3 in the longitudinal direction and the rotational axis direction of the cross flow fan 8 matches the left-right direction of the indoor unit 1 main body; and the deflectors 18 that are provided in the indoor unit 1 main body and oppose the outlet airflows blown from the fan extensions 8*a*, which are portions of the cross flow fan 8 positioned beyond the both ends of the air outlet 3 in the longitudinal direction. The cross flow fan 8 includes individual impeller units 14 having the plurality of blades 13 provided in the circumferential direction of the annular support plate 12. The blade shape of the deflector opposing blade portion 13*a* of the extension 8*a* is different from that of the air outlet opposing blade portion 13*b* opposing the air outlet 3. The blade shape of the deflector opposing blade portion 13*a* is formed so as to obtain the outlet airflow Aa, the wind speed Va of which is lower than that of the outlet airflow Ab blown from the air outlet opposing blade portion 13*b* opposing the air outlet 3. The cross flow fan 8 is operated so that the stagnation pressure between the deflector 18 and the extension 8*a* is higher than the atmospheric pressure. Thus, the stagnation pressure P1 higher than the atmospheric pressure P0 is generated in front of the deflector 18 by the outlet airflow Aa. This can prevent reverse suction in which the indoor air flows from the outside of the indoor unit 1 into the indoor unit 1 through the air outlet 3. By preventing this reverse suction, turbulence of the airflow can be reduced, and accordingly, scattering of water droplets during cooling operation of the air-conditioning apparatus can be prevented. Also, a large air volume of the airflow Ab blown from the air outlet 3 can be reliably obtained, and accordingly, the performance of the fan can be improved. Furthermore, the wind speed Va of the outlet airflow Aa directed toward the deflector 18 can be smaller than the wind speed of the outlet airflow Ab directed toward the air outlet 3. Thus, an air-conditioning apparatus can be obtained, with which the energy loss and noise caused when the airflow impinges upon the deflector 18 can be suppressed.

In particular, when a line segment that connects the outer circumferential blade end portion G and the inner circumferential blade end portion H to each other in a section perpendicular to the rotational axis 17 of the blade 13 is defined as the chord line M, the length of the chord line Ma of the blade 13*a* of the fan extension 8*a* is set to be shorter than the length of the chord line Mb of the blade 13*b* opposing the air outlet 3. Thus, energy provided to the airflow changes in accordance with the length of the chord line M, and the wind speed Va of the outlet airflow Aa blown from the deflector opposing blade portion 13*a*, which is the blade of the fan extension 8*a*, is lower than the wind speed Vb of the outlet airflow Ab blown from the air outlet opposing blade portion 13*b* opposing the air outlet 3. Accordingly, the energy loss can be suppressed and reverse suction can be prevented, and noise due to an airflow generated at the deflector 18 can be reduced. In addition, the outlet airflow Ab, which flows at the speed Vb higher than the speed Va of the outlet airflow Aa blown from the blade portion 13*a* opposite the deflector 18, is blown from the blade portion 13*b* opposing the air outlet 3 so as to allow a large air volume to be reliably obtained from the entire fan.

Although the chord line Mb of the air outlet opposing blade portion 13*b* is longer than the chord line Ma of the deflector opposing blade portion 13*a* and the difference in length between the chord lines is 2 to 3 mm herein, the lengths of the chord lines are not limited to these. It is sufficient that the chord line Mb of the air outlet opposing blade portion 13*b* be longer than the length of the chord line Ma of the deflector opposing blade portion 13*a* by one eighth to one third of the length of the chord line Ma of the deflector opposing blade portion 13*a*. For example, when the chord line Ma is set to 12 mm, the chord line Mb is set to 13.5 to 16 mm. When the chord line Mb is shorter than 13.5 mm, the effect of increasing the air volume cannot be obtained, and when the chord line Mb is longer than 16 mm, the size of the step DG in the boundary region increases in each of the end units 14*a*, and accordingly, air cannot smoothly flow.

In order to obtain the chord lines M having different lengths, the outer circumferential blade end portions Ga and Gb are set at the same position and the inner circumferential blade end portions Ha and Hb are set at different positions in a single blade. However, the positional settings are not limited to these. Alternatively, the outer circumferential blade end portions Ga and Gb may be set at positions different from each other. The inner circumferential blade end portions Ha and Hb may be set at positions different from each other and the outer circumferential blade end portions Ga and Gb may be set at positions different from each other.

Preferably, the boundary portion D illustrated in FIG. 11, the boundary portion D being a portion where the sectional shape of the blade is changed, is positioned near a deflector end surface 18*a* in the rotational axis direction AX. The position of the boundary portion D may be slightly shifted due to errors in manufacturing or installation. However, the deflector 18 has a certain width in the rotational axis direction AX. Thus, even when the deflector end surface 18*a* is not exactly aligned with the boundary portion D where the sectional shape of the blade is changed, there is no problem as long as the stagnation pressure P1 higher than the atmospheric pressure P0 can be generated at least in part of the impinging region E3. When the boundary portion D where the blade shape is changed is shifted further to the deflector 18 side than the deflector end surface 18*a*, the airflow Ab, which has passed between the blades having the chord line Mb longer than the chord line Ma and has much energy, impinges upon the deflector 18, thereby slightly increasing an energy loss. However, the stagnation pressure P1 is increased, and accordingly, reverse suction, in which air flows into the space S through the air outlet 3, can be reliably prevented. In contrast, when the boundary portion D where the sectional shape of the blade is changed is shifted further to the air outlet 3 side than the deflector end surface 18*a*, the airflow Aa, which has passed between the blades having the chord line Ma shorter than the chord line Mb and has a small amount of energy, flows through the air outlet 3, thereby slightly reducing the air volume. However, since it is ensured that the airflow Ab having much energy does not impinges upon the deflector 18, an increase in the energy loss can be suppressed. In either case, the stagnation pressure P1 higher than the atmospheric pressure P0 can be generated near the both end portions of the air outlet 3 in the longitudinal direction, and accordingly, reverse suction, in which air flows into the indoor unit 1 main body through the air outlet 3, can be prevented.

Figure 15:
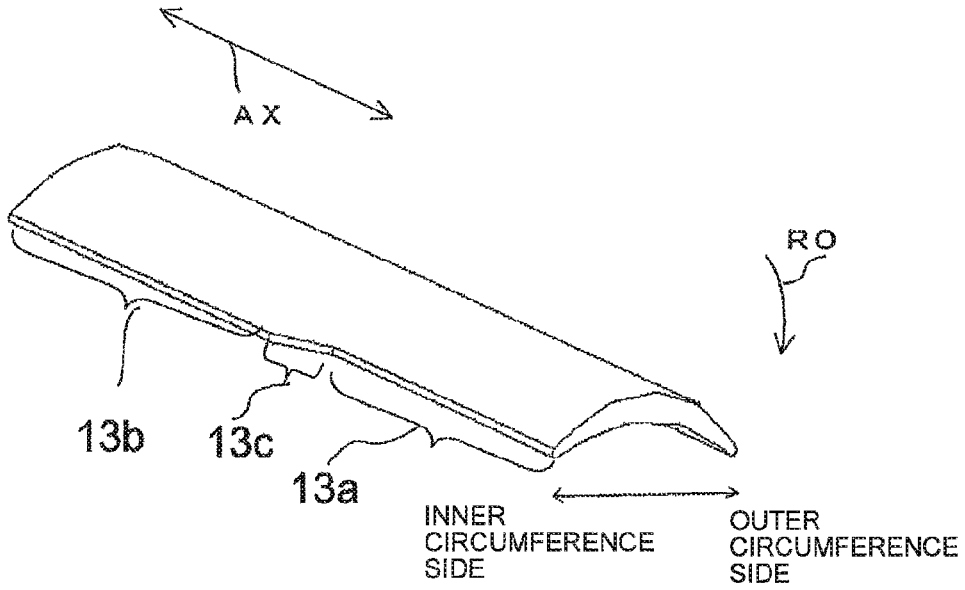
FIG. 15 is an enlarged perspective view of one of the blades, illustrating an alternative example of the structure of the cross flow fan according to Embodiment 1.

FIG. 15 is an enlarged perspective view of one of the blades 13, illustrating an alternative example of the structure of the cross flow fan used in the air-conditioning apparatus according to Embodiment 1. In the end unit 14*a* of the cross flow fan 8, the deflector opposing blade portion 13*a* and the air outlet opposing blade portion 13*b* are formed to have respective blade sectional shapes different from each other, and a transition portion 13*c* is provided between two sectional shapes (13*a* and 13*b*) so as to connect two sectional shapes to each other with a smoothly curved surface or a linear surface in the rotational axis direction AX. For example, referring to FIG. 11, the step-shaped step DG is formed in the boundary portion D between the blade portions having different shapes. In the example illustrated in FIG. 15, the two differently shaped blade portions are connected by an inclined straight line so that the blade sectional shape is smoothly changed, thereby forming the transition portion 13*c*. When the size of the step is 2 mm, positions 1 mm away from the boundary portion D on the left and right in the rotational axis direction AX are connected to each other by a straight line so as to form the transition portion 13*c*.

In the two types of significantly different sectional shapes (13*a* and 13*b*) on one and the other side of the boundary portion D as illustrated in FIG. 11, the step DG is formed between the deflector opposing blade portion 13*a* and the air outlet opposing blade portion 13*b*, thereby generating the difference in wind speed among airflows flowing near the step DG. Thus, a mixture of flows at different wind speeds develops into a vortex, thereby increasing the energy loss. Furthermore, there may be an increase in noise due to the turbulent airflows impinging upon the deflector 18. In this situation, the energy loss can be reduced and the increase in noise can be prevented by suppressing the generation of a vortex by the transition portion 13*c*.

The transition portion 13*c* does not necessarily have a shape so as to connect the deflector opposing blade portion 13*a* and the air outlet opposing blade portion 13*b* to each other by a straight line. The transition portion 13*c* may have another shape. For example, the deflector opposing blade portion 13*a* and the air outlet opposing blade portion 13*b* may be connected by an arc shaped curve. In this case, the arc shape may be convex toward the air outlet 3 side or concave toward the air outlet 3 side.

Figure 16:
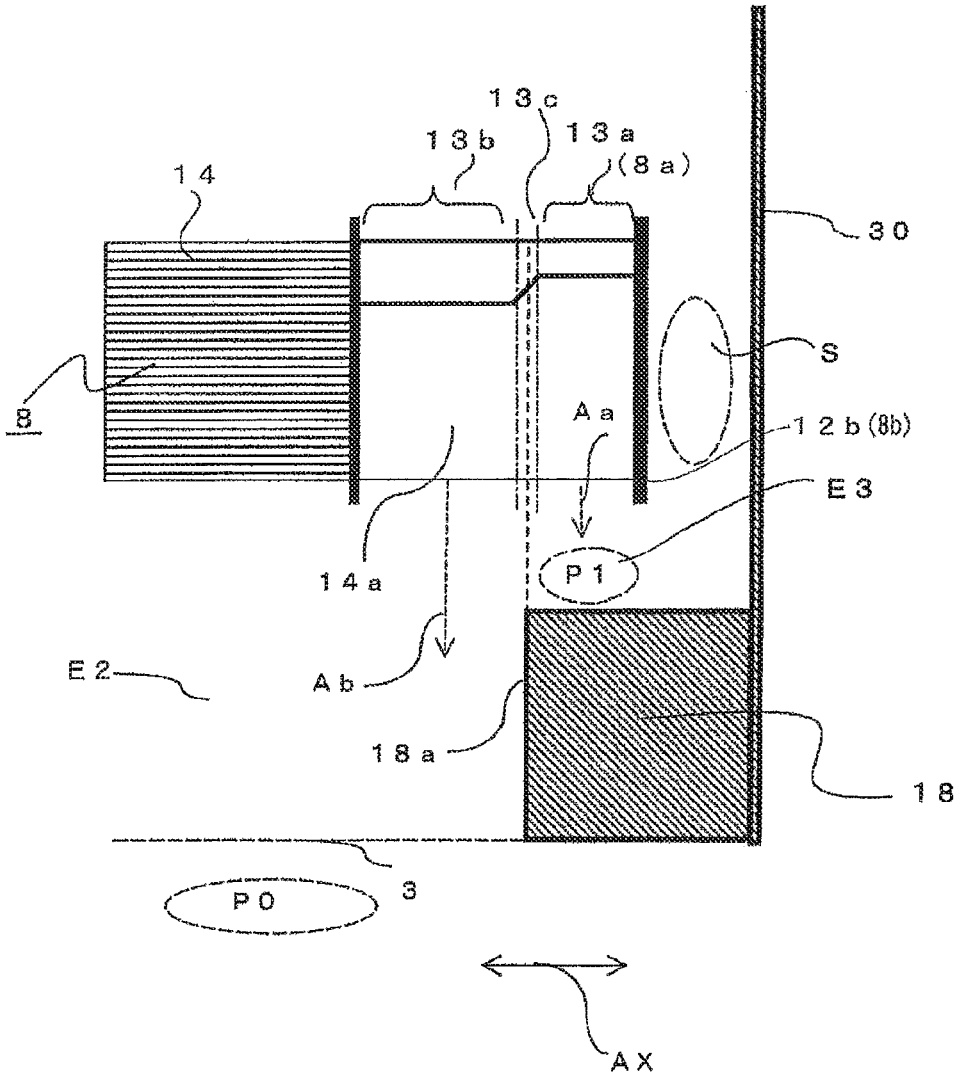
FIG. 16 is an enlarged explanatory view of the blade of the end unit of the cross flow fan and a region around the blade according to Embodiment 1.

FIG. 16 is an enlarged explanatory view of the blades 13*a* and 13*b* and a region around the blades 13*a* and 13*b* of the end unit 14*a* of the cross flow fan 8 according to Embodiment 1. Preferably, as illustrated in FIG. 16, the transition portion 13*c* between the deflector opposing blade portion 13*a* and the air outlet opposing blade portion 13*b* is positioned near the deflector end surface 18*a* in the rotational axis direction AX. However, there is no problem even when the position of the transition portion 13*c* is slightly shifted due to errors in manufacturing or installation. Similarly to the above description, when the transition portion 13*c* where the blade shape is changed is shifted further to the deflector 18 side than the deflector end surface 18*a*, an airflow, which has passed between the blades longer than the chord line Ma and has much energy, impinges upon the deflector 18, thereby slightly increasing an energy loss. However, the stagnation pressure P1 is increased, and accordingly, reverse suction, in which air flows into the space S through the air outlet 3, can be reliably prevented. In contrast, when the transition portion 13*c* where the sectional shape of the blade is changed is shifted further to the air outlet 3 side than the deflector end surface 18*a*, an airflow, which has passed between the blades shorter than the chord line Mb and has a small amount of energy, flows through the air outlet 3, thereby slightly reducing the air volume. However, since the airflow having much energy does not impinge upon the deflector 18, an increase in the energy loss can be prevented.

As described above, in Embodiment 1, in the boundary portion D where the blade shape is changed in the rotational axis direction AX of the cross flow fan 8, the blade shapes of the deflector opposing blade portion 13*a* and the air outlet opposing blade portion 13*b* are connected to each other by an inclined straight line or a convex or concave curved shape so that the blade shapes are smoothly changed. With this structure, generation of a vortex in a portion where the blade shapes is changed is prevented, and accordingly, the energy loss can be reduced.

Embodiment 2

Figure 17:
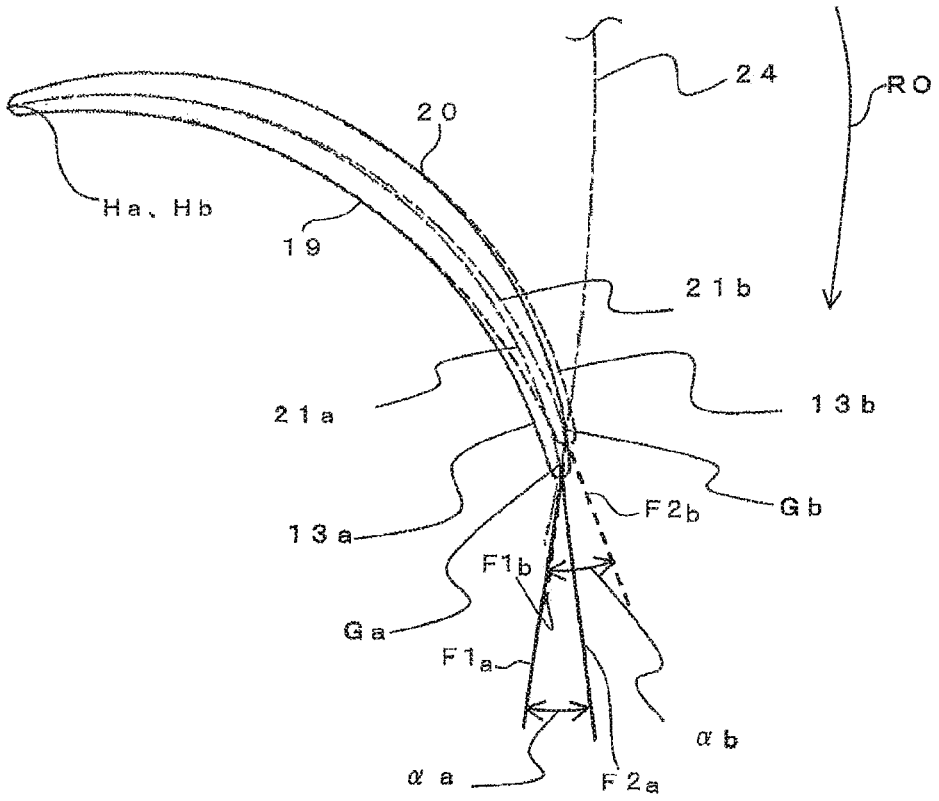
FIG. 17 is an explanatory view, in which blade sections of an air outlet opposing blade portion and a deflector opposing blade portion in an end unit of a cross flow fan according to Embodiment 2 of the present invention are superposed with each other.

FIG. 17 is an explanatory view illustrating a section perpendicular to the rotational axis 17, in which the blade sections of the air outlet opposing blade portion 13*b* and the deflector opposing blade portion 13*a* in the end unit 14*a* of the cross flow fan 8 according to Embodiment 2 of the present invention are superposed with each other. In the drawing, the same signs as those of Embodiment 1 denote similar or equal elements. The shape around the end unit 14*a* in the indoor unit 1 of the air-conditioning apparatus is similar to that illustrated in FIGS. 1 to 9. Similarly to Embodiment 1, the blade shapes of the deflector opposing blade portion 13*a* in the fan extension 8*a* opposite the deflector 18 and the air outlet opposing blade portion 13*b* opposing the air outlet 3 are different from each other. Particularly in Embodiment 2, outlet angles α of the outer circumferential blade end portions Ga and Gb are different from each other.

Here, the outlet angle α is described. It is defined that, in a section of the blade 13 perpendicular to the rotational axis 17, the locus of rotation of the outer circumferential blade end portion Ga, Gb is the blade outer diameter 24, the camber line 21 is a line that extends in the center between the positive pressure surface 19, which is at the front in the rotational direction of the blade 13, and the negative pressure surface 20, which is at the rear in the rotational direction, and the outlet angle α is an angle formed between a tangent of the blade outer diameter 24 and the tangent of the camber line 21 at an intersection of the blade outer diameter 24 and the camber line 21. Thus, an outlet angle αa of the deflector opposing blade portion 13*a* is an angle formed between a tangent F1*a* (indicated by the solid line) of the blade outer diameter 24 and the tangent F2*a* (indicated by the solid line) of the camber line 21*a* at the outer circumferential blade end portion Ga, which is an intersection of the blade outer diameter 24 and the camber line 21*a*. An outlet angle αb of the air outlet opposing blade portion 13*b* is an angle formed between a tangent F1*b* (indicated by the dotted line) of the blade outer diameter 24 and the tangent F2*b* (indicated by the dotted line) of the camber line 21*b* at the outer circumferential blade end portion Gb, which is an intersection of the blade outer diameter 24 and the camber line 21*b*.

In Embodiment 2, the outlet angle αa of the deflector opposing blade portion 13*a* is smaller than the outlet angle αb of the air outlet opposing blade portion 13*b*. For example, the outlet angle αa of the deflector opposing blade portion 13*a* is set to 24 to 26 degrees, and the outlet angle αb of the air outlet opposing blade portion 13*b* is set to 26 to 28 degrees. Here, the inner circumferential blade end portion Ha of the deflector opposing blade portion 13*a* and the inner circumferential blade end portion Hb of the air outlet opposing blade portion 13*b* are set at the same position.

Figure 18:
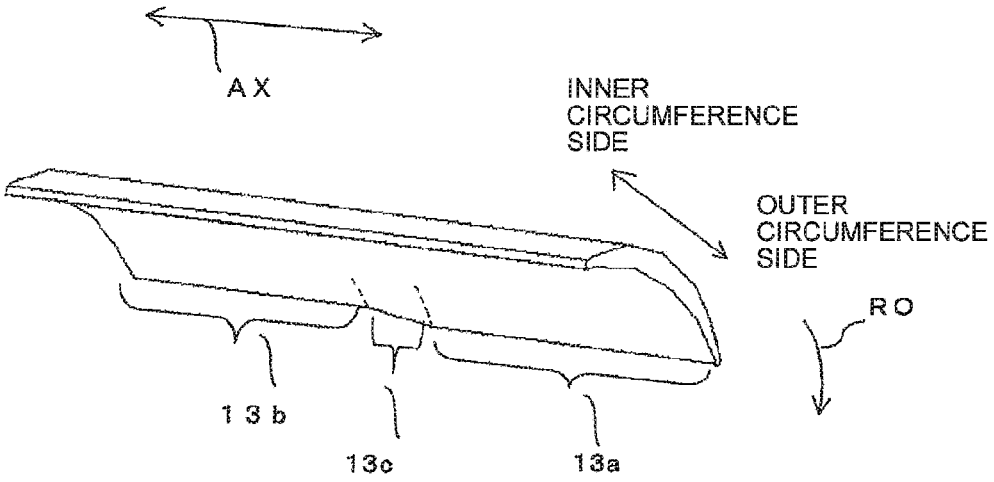
FIG. 18 is a perspective view of one of blades of the end unit according to Embodiment 2.

FIG. 18 is a perspective view of one of the blades 13 of the end unit 14*a* according to Embodiment 2. In this example of the structure, the transition portion 13*c* is provided between the deflector opposing blade portion 13*a* and the air outlet opposing blade portion 13*b* so as to have a smoothly changed shape. For example, instead of the step DG formed in the boundary portion D between the different blade shapes as illustrated in FIG. 11, the boundary portion D has a certain width in the rotational axis direction AX, for example, a width extending to the left and right by several mm from the boundary portion D, and this width is defined as the transition portion 13*c*. The transition portion 13*c* has a straight line inclined in the left-right direction and the blade outer diameter 24 direction, a concave curve, or a convex curve so as to smoothly connect the deflector opposing blade portion 13*a* and the air outlet opposing blade portion 13*b* to each other.

Figure 19:
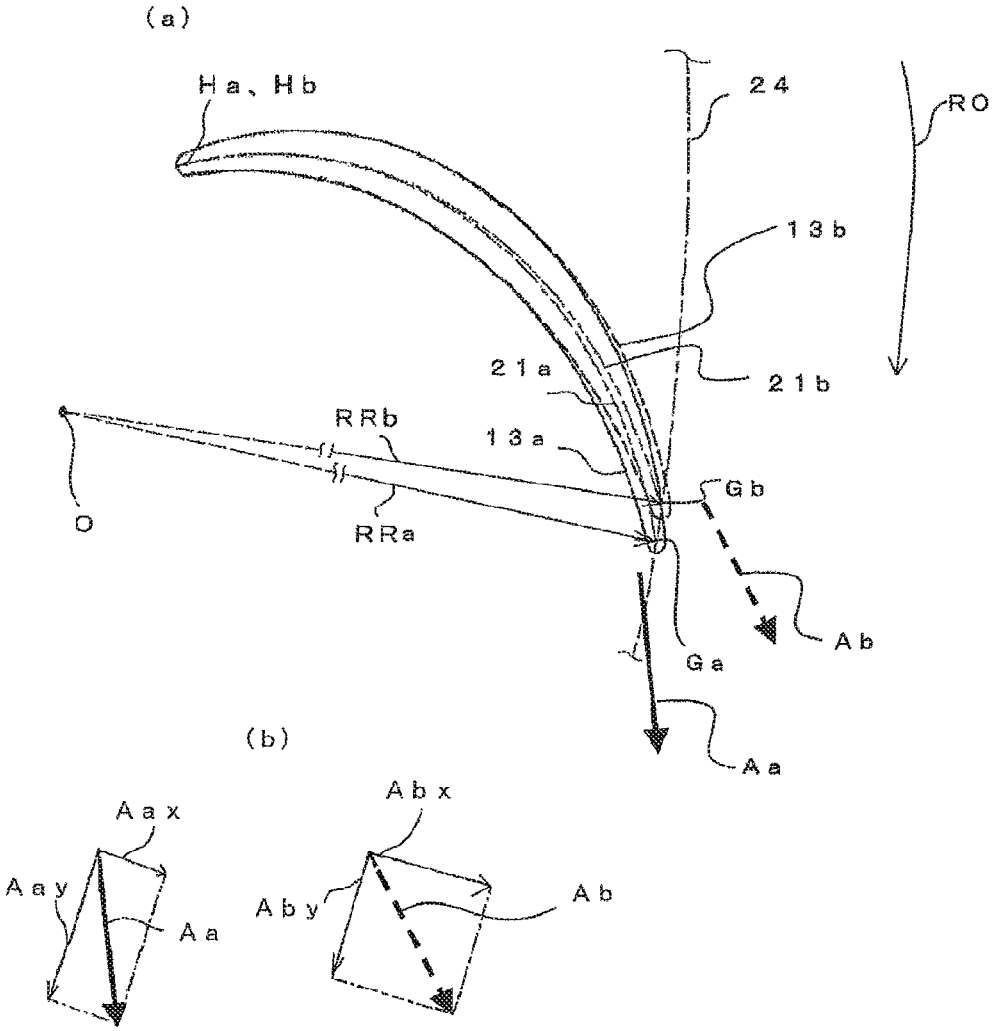
FIG. 19 includes explanatory views of airflows blown from blade portions of the end unit according to Embodiment 2.

FIG. 19 includes explanatory views illustrating airflows flowing between the blades having the blade portions 13*a* and 13*b* of the end unit 14*a* according to Embodiment 2. FIG. 19 (*a*) illustrates the sections of the blade portions 13*a* and 13*b* superposed with each other, the sections being perpendicular to the rotational axis 17. FIG. 19 (*b*) illustrates the flowing directions of the outlet airflows Aa and Ab blown from the outer circumferential blade end portions Ga and Gb, comparing the outlet airflows Aa and Ab with each other. Airflows having flowed between the blades through the inner circumferential blade end portion Ha, Hb receive energy by being pressed by the positive pressure surface 19 of the blade 13 and flow through the outer circumferential blade end portions Ga and Gb to the air outlet region E2. When the airflows Aa and Ab leave the positive pressure surface 19 of the blade 13 and are blown toward the air outlet region E2, the airflows Aa and Ab are blown in the tangent F2*a* and F2*b* directions of the respective camber lines 21*a* and 21*b*. Since the outlet angle αa of the deflector opposing blade portion 13*a* is smaller than the outlet angle αb of the air outlet opposing blade portion 13*b*, the direction of the tangent F2*a* of the camber line 21*a* at the outer circumferential blade end portion Ga more closely follows the rotational direction (RO direction) than the tangent F2*b* of the camber line 21*b* at the outer circumferential blade end portion Gb does. In contrast, the direction of the tangent F2*b* of the camber line 21*b* at the outer circumferential blade end portion Gb more closely follows the fan radial direction (direction indicated by the solid arrow RRa in FIG. 19) than the outlet airflow Aa does. Here, in a section perpendicular to the rotational axis 17, the fan diameter is a straight line connecting the rotational center O and each outer circumferential blade end portion G of the blade 13, and the fan radial direction RR is a direction extending from the rotational center O toward each outer circumferential blade end portion G of the blade 13. In FIG. 19, for example, the fan radial direction of the deflector opposing blade portion 13*a* (RRa direction: direction extending from rotational center O toward the outer circumferential blade end portion Ga) is illustrated, and the fan radial direction (RRb direction) of the air outlet opposing blade portion 13*b* is a direction extending from the rotational center O toward the outer circumferential blade end portion Gb. Regarding the rotational direction (RO direction), the rotational direction (RO direction) of the deflector opposing blade portion 13*a* is a direction extending forward in the rotational direction (RO direction) on the tangent F1*a* (see FIG. 17) of the blade outer diameter 24 at the outer circumferential blade end portion Ga, and the rotational direction (RO direction) of the air outlet opposing blade portion 13*b* is a direction extending forward in the rotational direction (RO direction) on the tangent F1*b* of the blade outer diameter 24 at the outer circumferential blade end portion Gb.

As described above, blowing directions of the outlet airflows Ab and Aa blown between the blades vary in accordance with the outlet angle α.

FIG. 19 (*b*) illustrates the outlet airflows Aa and Ab resolved into the fan radial direction (RR direction) components Aax and Abx and the fan rotational direction (RO direction) components Aay and Aby. The cross flow fan 8 causes air sucked from the air inlet region E1 to pass between the blades and blows an airflow between the blades mainly in a direction in which the proportion of the fan radial direction (RR direction) component is large. The airflow blown between the blades is gradually guided toward the air outlet 3 by the rear guide 10 formed on the rear surface of the outlet air path 11. Thus, near the air outlet 3, the wind speed of the airflow having a large proportion of the fan radial direction (RR direction) component is higher than that of the airflow having a large proportion of the rotational direction (RO direction) component. As illustrated in FIG. 19 (*b*), since the outlet angle αa is smaller than the outlet angle αb of the air outlet opposing blade portion 13*b*, in the direction of the airflow blown from the deflector opposing blade portion 13*a*, the rotational direction (RO direction)

component Aay is larger than the rotational direction (RO direction) direction component Aby. In contrast, the fan radial direction (RR direction) component Aax is smaller than the fan radial direction (RR direction) component Abx. Thus, in the air outlet region E2, the wind speed Va of the airflow Aa passing between the blades of the deflector opposing blade portions 13*a* and directed toward the impinging region E3 is lower than the wind speed Vb. That is, the proportions of the fan radial direction component and the rotational direction component of the outlet airflow change in accordance with the outlet angle αb, and when the fan radial direction component is large, the wind speed of the outlet airflow becomes higher.

Figure 20:
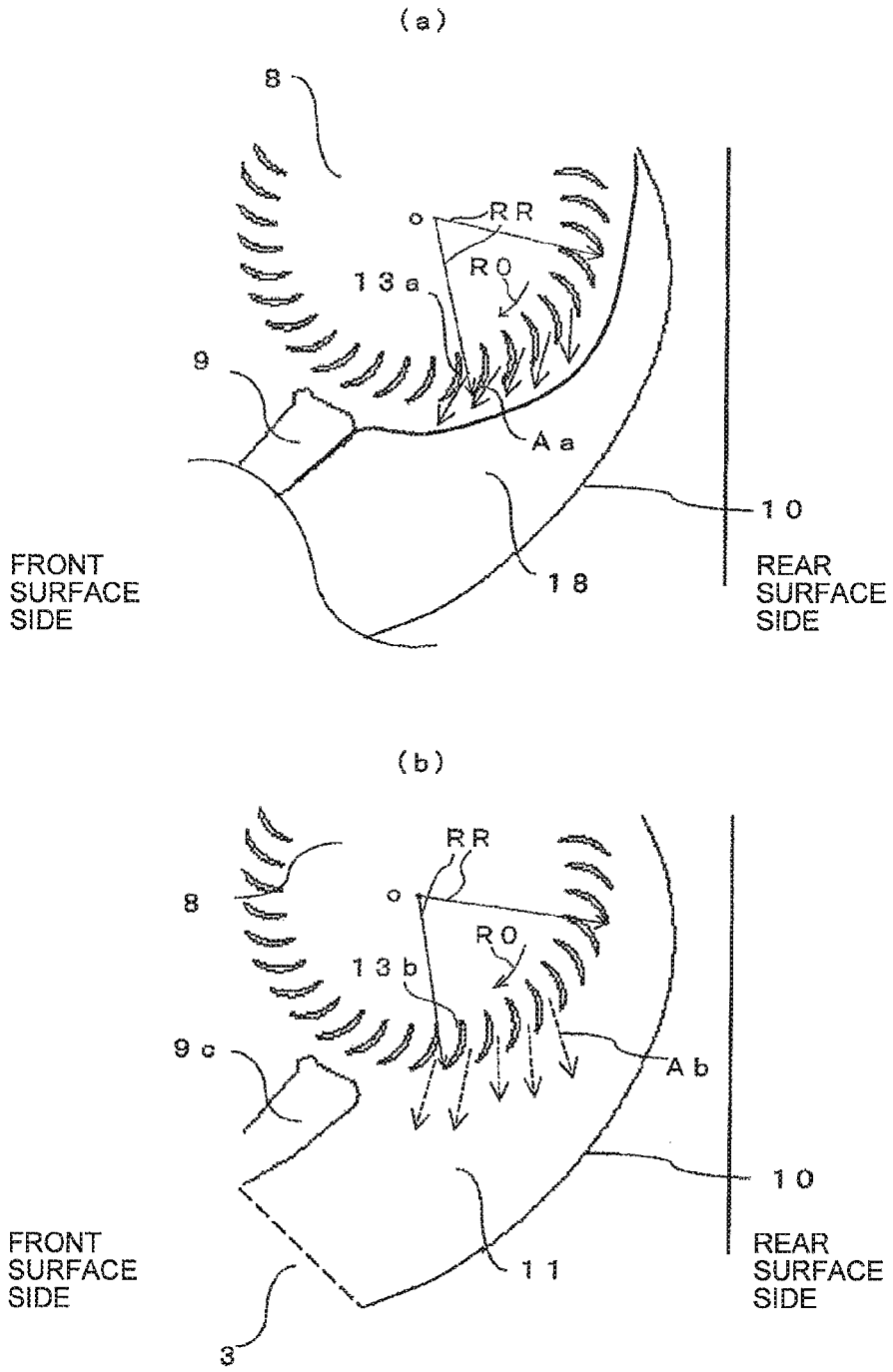
FIG. 20 includes explanatory views illustrating airflows passing between the blades according to Embodiment 2.

FIGS. 20 (*a*) and 20 (*b*) are explanatory views of the airflows blown between the blades having the blade portions 13*a* and 13*b* of the end unit 14*a* according to Embodiment 2. FIG. 20 (*a*) illustrates the section of the deflector opposing blade portion 13*a* perpendicular to the rotational axis 17. FIG. 20 (*b*) illustrates the section of the air outlet opposing blade portion 13*b* perpendicular to the rotational axis 17. As indicated by the solid arrows in FIG. 20 (*a*), the flows of the airflow Aa are directed in the rotational direction (RO direction) in the deflector opposing blade portion 13*a*. Thus, the wind speed Va of the airflow that substantially perpendicularly impinges upon the deflector 18 is lower than the wind speed Vb of the airflow Ab, which flows in a fan radial direction (RR direction). With the airflow passes the deflector opposing blade portion 13*a* and impinges upon the deflector 18, the stagnation pressure P1 is generated through conversion of energy of the wind speed Va into pressure energy. At this time, it is preferable that the stagnation pressure P1 be slightly higher than the atmospheric pressure P0. In the case where the stagnation pressure P1 is excessively high, the energy loss due to the impingement is increased, thereby increasing the energy loss or noise. In Embodiment 2, the directions of the flows of the airflow Aa that flow and pass the blade portion 13*a* more closely follow the rotational direction (RO direction) than those of the airflow Ab do. Thus, the wind speed Va of the airflow Aa that impinges upon the deflector 18 is lower than the wind speed Vb, thereby weakening the impinging flow. Accordingly, the energy loss and noise can be suppressed.

In particular, when determining the outlet angle αa of the deflector opposing blade portion 13*a*, it is desirable that the deflector opposing blade portion 13*a* has a shape so as to provide a minimum energy to the airflow, the minimum energy being energy with which the stagnation pressure P1 is slightly higher than the atmospheric pressure P0 in an operational mode in which the fan is rotated at the lowest rotation speed. By obtaining the stagnation pressure P1 higher than the atmospheric pressure P0, reverse suction, in which air flows from the outside of the indoor unit 1 into the indoor unit 1, can be prevented. Furthermore, since the minimum stagnation pressure P1 required to prevent reverse suction is obtained, the energy loss due to the impinging flow can be reduced and an increase in noise can be suppressed.

In the air outlet opposing blade portion 13*b* opposing the air outlet 3, the outlet angle αb is larger than the outlet angle αa of the deflector opposing blade portion 13*a*. Thus, as indicated by the dotted arrows in FIG. 20 (*b*), the blowing directions of the flows of the airflow Ab more closely follow the fan radial direction (RR direction) than those of the airflow Aa do. As illustrated in FIG. 19 (*b*), the fan radial direction (RR direction) component Abx of the outlet airflow Ab is larger than the fan radial direction (RR direction) component Aax of the deflector opposing blade portion 13*a*, and the wind speed Vb of the airflow Ab directed toward the air outlet 3 is higher than the wind speed Va of the airflow Aa directed toward the deflector 18. Thus, the wind speed (air volume) directed toward the air outlet 3 can be increased compared to the structure in which all the blades of the entire cross flow fan 8 have the same shape as the deflector opposing blade portion 13*a*. Furthermore, since a sufficient wind speed (air volume) can be obtained by the air outlet opposing blade portion 13*b* opposing the air outlet 3, a large air volume can be obtained from the entire cross flow fan 8. Thus, the performance of the fan can be improved and power consumption can be reduced. Since the wind speed (air volume) of air blown from the air outlet 3 over a range from the one end to the other end of the air outlet 3 in the longitudinal direction can be increased, reverse suction, in which air attempts to flow from the outside of the indoor unit 1 into the indoor unit 1 through the air outlet 3, can be prevented.

As described above, according to Embodiment 2, it is defined that, in a section of the blade 13 perpendicular to the rotational axis 17, the blade outer diameter 24 is the locus of rotation of the outer circumferential blade end portion G, the camber line 21 is a line that extends in the center between the positive pressure surface 19, which is at the front in the rotational direction of the blade 13, and the negative pressure surface 20, which is at the rear in the rotational direction, and the outlet angle α is an angle formed between the tangent F1 of the blade outer diameter 24 and the tangent F2 of the camber line 21 at an intersection of the blade outer diameter 24 and the camber line 21. Here, by setting the outlet angle αa of the blade 13*a* of the fan extension 8*a* to be smaller than the outlet angle αb of the blade 13*b* opposing the air outlet 3, the proportions of the fan radial direction component and the rotational direction component of the outlet airflow change in accordance with the outlet angle α. With the blade 13*a* of the extension 8*a*, the outlet airflow Aa can be obtained. The outlet airflow Aa flows at the wind speed Va lower than the wind speed Vb of the outlet airflow Ab blown from the blade 13*b* opposing the air outlet 3. This outlet airflow Aa causes the stagnation pressure P1 higher than the atmospheric pressure P0 to be generated in front of the deflector 18. This can prevent reverse suction in which the indoor air flows from the outside of the indoor unit 1 into the indoor unit 1 through the air outlet 3. Also, a large air volume of the airflow Ab blown from the air outlet 3 can be reliably obtained, and accordingly, the performance of the fan can be improved. Furthermore, in comparison with the wind speed Vb of the outlet airflow Ab blown toward the air outlet 3, the wind speed Va of the outlet airflow Aa blown toward the deflector 18 can be reduced. Thus, an air-conditioning apparatus can be obtained, with which the energy loss and noise caused when the airflow impinges upon the deflector 18 can be suppressed.

Here, in order to obtain the outlet angles α different from each other, the inner circumferential blade end portions Ha and Hb are set at the same position and the outer circumferential blade end portions Ga and Gb are set at different positions in a single blade. However, the positional settings are not limited to these. Alternatively, the inner circumferential blade end portions Ha and Hb may be set at positions different from each other. The outer circumferential blade end portions Ga and Gb may be set at positions different from each other and the inner circumferential blade end portions Ha and Hb may be set at positions different from each other.

Embodiment 3

Figure 21:
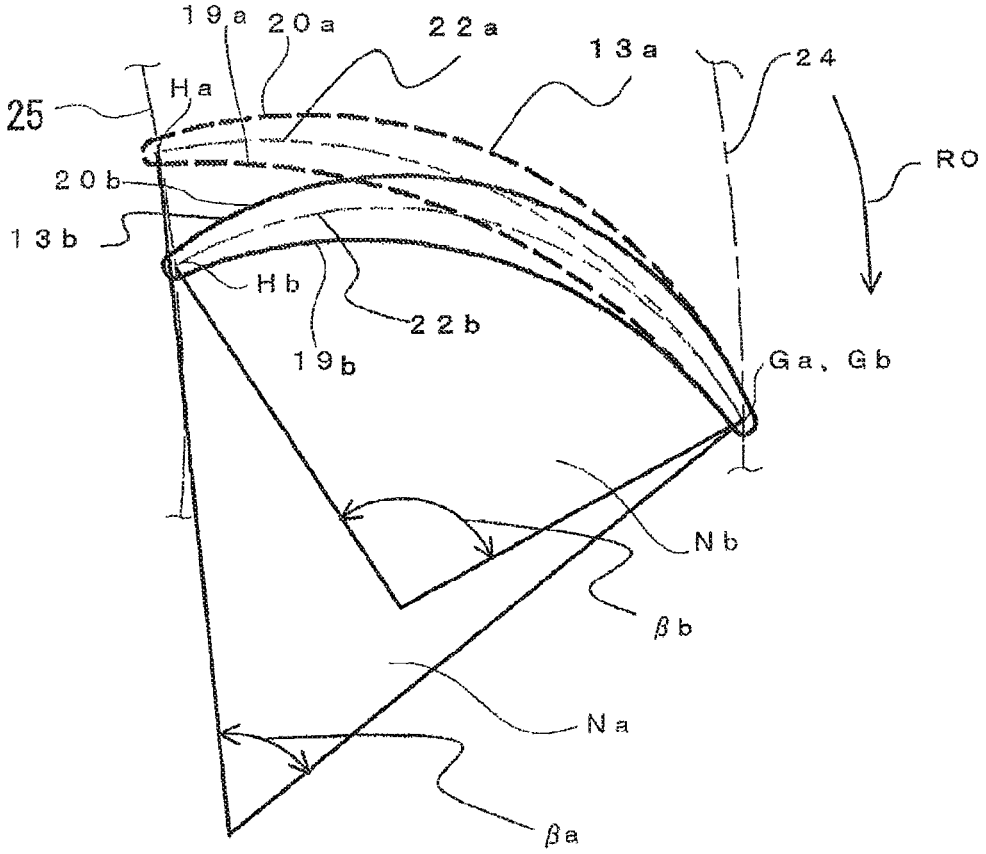
FIG. 21 is an explanatory view, in which blade sections of an air outlet opposing blade portion and a deflector opposing blade portion in an end unit of a cross flow fan according to Embodiment 3 of the present invention are superposed with each other.

FIG. 21 is an explanatory view illustrating a section perpendicular to the rotational axis 17, in which the blade sections of the air outlet opposing blade portion 13*b* and the deflector opposing blade portion 13*a* of the end unit 14*a* of the cross flow fan 8 according to Embodiment 3 of the present invention and used in the air-conditioning apparatus are superposed with each other. In the drawing, the same signs as those of Embodiment 1 denote similar or equal elements. The shape around the end unit 14*a* in the indoor unit 1 is similar to that illustrated in FIGS. 1 to 9. Similarly to Embodiment 1, the blade shapes of the deflector opposing blade portion 13*a*, which is the blade portion of the fan extension 8*a* opposite the deflector 18, and the air outlet opposing blade portion 13*b* opposing the air outlet 3 are different from each other. Particularly in Embodiment 3, camber angles β are different from each other in the blade section. In a section of the blade 13 perpendicular to the rotational axis 17, a camber line 22 is a line connecting central points of the positive pressure surface 19, which is at the front in the rotational direction of the blade 13, and the negative pressure surface 20, which is at the rear in the rotational direction, from the inner circumferential blade end portion H to the outer circumferential blade end portion G. The camber line 22 has a substantially arc shape. The camber angle β is a central angle (open angle) of the arc-shaped camber line 22. For example, a camber line 22*a* of the deflector opposing blade portion 13*a* is an arc connecting the inner circumferential blade end portion Ha and the outer circumferential blade end portion Ga, and the central angle of a sector Na, the arc of which is the camber line 22*a*, is a camber angle βα. A camber line 22*b* of the air outlet opposing blade portion 13*b* is an arc connecting the inner circumferential blade end portion Hb and the outer circumferential blade end portion Gb, and the central angle of a sector Nb, the arc of which is the camber line 22*b*, is a camber angle βb.

Here, the camber angle βa of the deflector opposing blade portion 13*a* and the camber angle βb of the air outlet opposing blade portion 13*b* are different from each other and satisfy the following relationship: camber angle βa<camber angle βb. For example, the camber angle βa of the deflector opposing blade portion 13*a* is set to about 40 degrees, and the camber angle βb of the air outlet opposing blade portion 13*b* is set to about 45 degrees.

Figure 22:
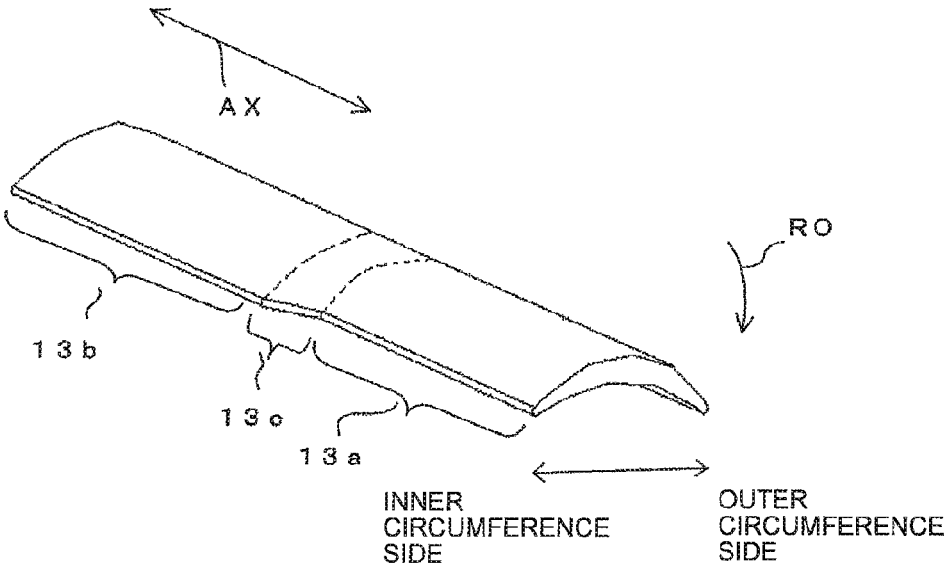
FIG. 22 is a perspective view of one of blades of the end unit according to Embodiment 3.

FIG. 22 is a perspective view of one of the blades of the end unit 14*a* according to Embodiment 3. In this example the structure, the transition portion 13*c* is provided between the deflector opposing blade portion 13*a* and the air outlet opposing blade portion 13*b* so as to smoothly change the shape of a single blade. For example, instead of the step DG formed in the boundary portion D between the different blade shapes as illustrated in FIG. 11, the boundary portion D has a certain width in the rotational axis direction AX, for example, a width extending to the left and right by several mm from the boundary portion D, and this width is defined as the transition portion 13*c*. The transition portion 13*c* has a straight line inclined in the left-right direction and the blade outer diameter 24 direction, a concave curve, or a convex curve so as to smoothly connect the deflector opposing blade portion 13*a* and the air outlet opposing blade portion 13*b* to each other.

Figure 23:
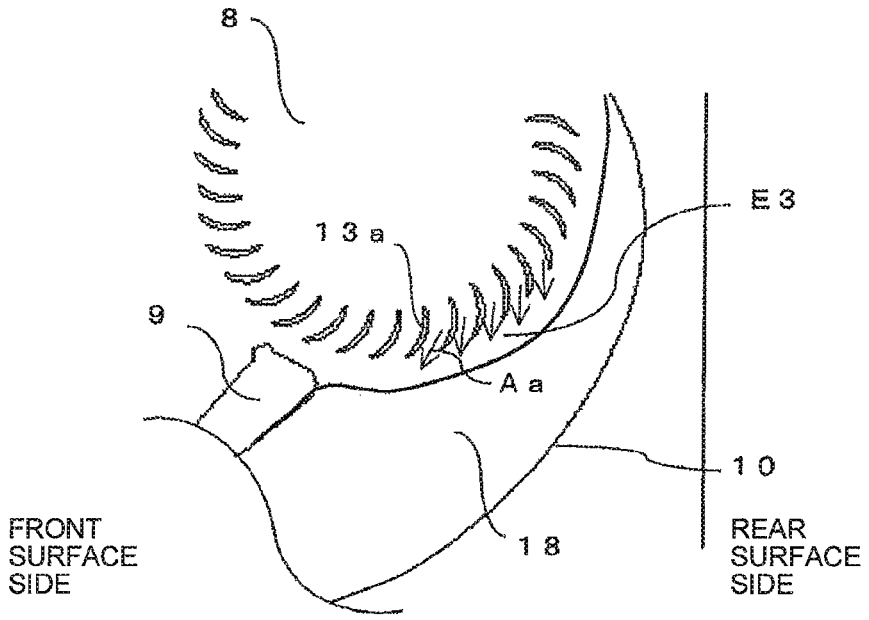
FIG. 23 includes explanatory views of airflows in blade portions of the end unit according to Embodiment 3.
Figure 23:
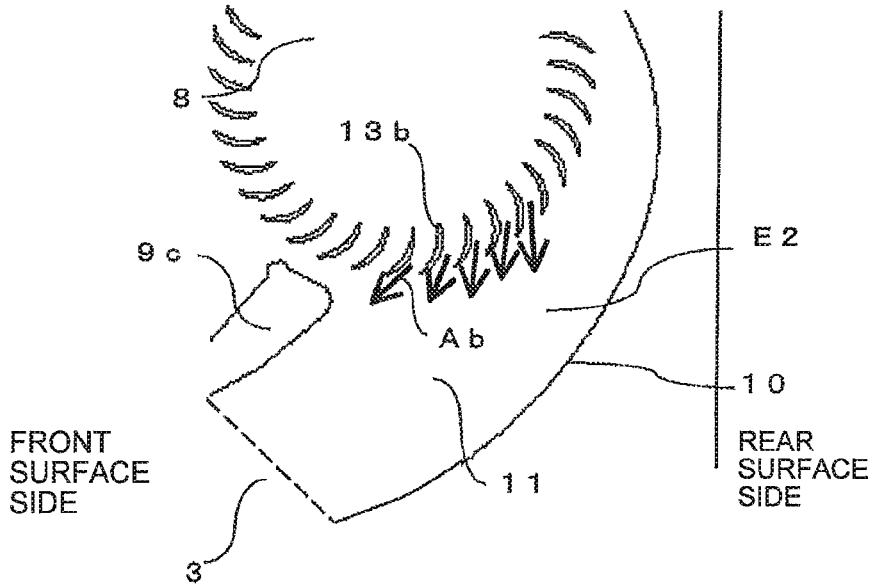

FIG. 23 includes explanatory views illustrating airflows blown from the deflector opposing blade portion 13*a* and the air outlet opposing blade portion 13*b* of the end unit 14*a* according to Embodiment 3. When the airflows Aa and Ab blown from the blade portions 13*a* and 13*b*, which have camber angles β different from each other, are compared, energy provided to the airflow Aa from the blade portion 13*a* is different from energy provided to the airflow Ab from the blade portion 13*b*. That is, when the positive pressure surface 19 of the blade 13 presses the airflow so as to provide energy to an airflow, as described in Embodiment 1, as the area of the positive pressure surface 19 increases, energy provided to the airflow increases. Also, when the positive pressure surface 19 has a significantly curved shape, the direction of the airflow is significantly bent at the positive pressure surface 19, thereby providing more energy to the airflow. In a shape as illustrated in FIG. 21, the camber angle βa of the deflector opposing blade portion 13*a* is smaller than the camber angle βb of the air outlet opposing blade portion 13*b*, and a positive pressure surface 19*a* is more gently curved than the positive pressure surface 19*b*. Thus, energy provided from the blade portion 13*a* to the airflow is smaller than that provided from the blade portion 13*b* having a large camber angle βb, and accordingly, the wind speed Va of the outlet airflow Aa is low. Thus, by setting the camber angle βa of the deflector opposing blade portion 13*a* to be smaller than the camber angle βb, the wind speed Va of the outlet airflow Aa becomes lower than the wind speed Vb of the outlet airflow Ab, thereby weakening the impinging flow that impinges upon the deflector 18. This can suppress an excessive increase in the stagnation pressure P1.

Here, in the case where the shapes of the deflector opposing blade portion 13*a* and the air outlet opposing blade portion 13*b* are differently formed so that the camber angle βa is smaller than the camber angle βb while the camber line 22*a* of the deflector opposing blade portion 13*a* coincides with the camber line 22*b* of the air outlet opposing blade portion 13*b*, this structure is equal to the following structure in which the curved shapes of the positive pressure surfaces 19 coincide with each other but the blade shapes have the chord lines of different lengths as described in Embodiment 1. As a result, the area of the positive pressure surface 19 increases as the camber angle β increases. Thus, regarding the wind speed of the outlet airflow, the wind speed Va of the outlet airflow Aa blown from the deflector opposing blade portion 13*a* having a small camber angle βa is lower than the outlet airflow Ab blown from the air outlet opposing blade portion 13*b* having a large camber angle βb.

In particular, when determining the camber angle βa of the deflector opposing blade portion 13*a*, it is desirable that the deflector opposing blade portion 13*a* has a shape so as to provide a minimum energy to the airflow, the minimum energy being energy with which the stagnation pressure P1 is slightly higher than the atmospheric pressure P0 in an operational mode in which the cross flow fan 8 is rotated at the lowest rotation speed. By obtaining the stagnation pressure P1 higher than the atmospheric pressure P0, reverse suction, in which air flows from the outside of the indoor unit 1 into the indoor unit 1, can be prevented. Furthermore, since the minimum stagnation pressure P1 required to prevent reverse suction is obtained, the energy loss due to the impinging airflow can be suppressed. Also, since the speed of the wind that impinges upon the deflector 18 is reduced, noise can be reduced.

Since the camber angle βb of the air outlet opposing blade portion 13*b* not opposing the deflector 18 is set to be larger than the camber angle βa of the deflector opposing blade portion 13*a*, the shape of the air outlet opposing blade portion 13*b* is more significantly curved than that of the positive pressure surface 19 of the deflector opposing blade portion 13*a*. This increases energy provided to the airflow by the blade portion 13*b*. Thus, the outlet airflow Ab passing between the blades 13*b* and provided with much energy is introduced into the air outlet 3 at the wind speed Vb higher than the wind speed Va. Since the sufficient wind speed Vb (air volume) can be obtained by the air outlet opposing blade portion 13*b* opposing the air outlet 3, a large air volume can be obtained from the entire cross flow fan 8. Thus, the performance of the fan can be improved and power consumption can be reduced. Since the outlet airflow Ab flowing at the sufficient wind speed of Vb (air volume) blown from the air outlet 3 over a range from the one end to the other end of the air outlet 3 in the longitudinal direction can be obtained, reverse suction, in which air attempts to flow from the outside of the indoor unit 1 into the indoor unit 1 through the air outlet 3, can be prevented.

As described above, according to Embodiment 3, it is defined that, in the section of the blade 13 perpendicular to the rotational axis 17, the camber line 22 is a line that extends in the center between the positive pressure surface 19, which is at the front in the rotational direction of the blade 13, and the negative pressure surface 20, which is at the rear in the rotational direction, and the central angle of the sector N, the arc of which is the camber line 22, is a camber angle β. Here, the camber angle βa of the deflector opposing blade portion 13*a* of the extension 8*a* is set to be smaller than the camber angle βb of the air outlet opposing blade portion 13*b* opposing the air outlet 3. Thus, energy provided to the airflow changes in accordance with the size of the camber angle β, and the outlet airflow Aa, the wind speed of which is lower than the wind speed Vb of the outlet airflow Ab blown from the air outlet opposing blade portion 13*b* opposing the air outlet 3, blown from the deflector opposing blade portion 13*a* of the fan extension 8*a* can be obtained. By causing the outlet airflow Aa to impinge upon the deflector 18, the stagnation pressure P1 higher than the atmospheric pressure P0 is generated in front of the deflector 18. This can prevent reverse suction in which the indoor air flows from the outside of the indoor unit 1 into the indoor unit 1 through the air outlet 3. By preventing this reverse suction, turbulence of the airflow can be reduced, and accordingly, scattering of water droplets during cooling operation of the air-conditioning apparatus can be prevented. Also, a large air volume of the airflow Ab blown from the air outlet 3 can be reliably obtained, and accordingly, the performance of the fan can be improved. Furthermore, the wind speed Va of the outlet airflow Aa directed toward the deflector 18 can be smaller than the wind speed of the outlet airflow Ab directed toward the air outlet 3. Thus, an air-conditioning apparatus can be obtained, with which the energy loss and noise caused when the airflow impinges upon the deflector 18 can be suppressed.

Here, in order to obtain the camber angles βa and βb of the deflector opposing blade portion 13*a* and the air outlet opposing blade portion 13*b* such that the camber angles βa and βb are different from each other, the outer circumferential blade end portions Ga and Gb are set at the same position and the inner circumferential blade end portions Ha and Hb are set at different positions in a single blade. However, the positional settings are not limited to these. The outer circumferential blade end portions Ga and Gb may be set at positions different from each other. Alternatively, the inner circumferential blade end portions Ha and Hb may be set at positions different from each other as well as the outer circumferential blade end portions Ga and Gb may be set at positions different from each other.

In Embodiments 2 and 3, a structure in which the transition portion 13*c* is provided between the deflector opposing blade portion 13*a* and the air outlet opposing blade portion 13*b* has been described. Despite this, as illustrated in FIG. 11 in Embodiment 1, the transition portion 13*c* may not be necessarily provided. However, generation of a vortex due to a portion where the blade shape is changed can be prevented and the effect of reducing the energy loss is produced when the boundary portion D between the different blade shapes in the rotational axis direction AX of the end unit 14*a* of the cross flow fan 8 is defined as the transition portion 13*c*, and the blade shapes of the deflector opposing blade portion 13*a* and the air outlet opposing blade portion 13*b* are connected to each other with an inclined straight line or a convex or concave curved shape so that one of the blade shapes is smoothly changed into the other.

Figure 24:
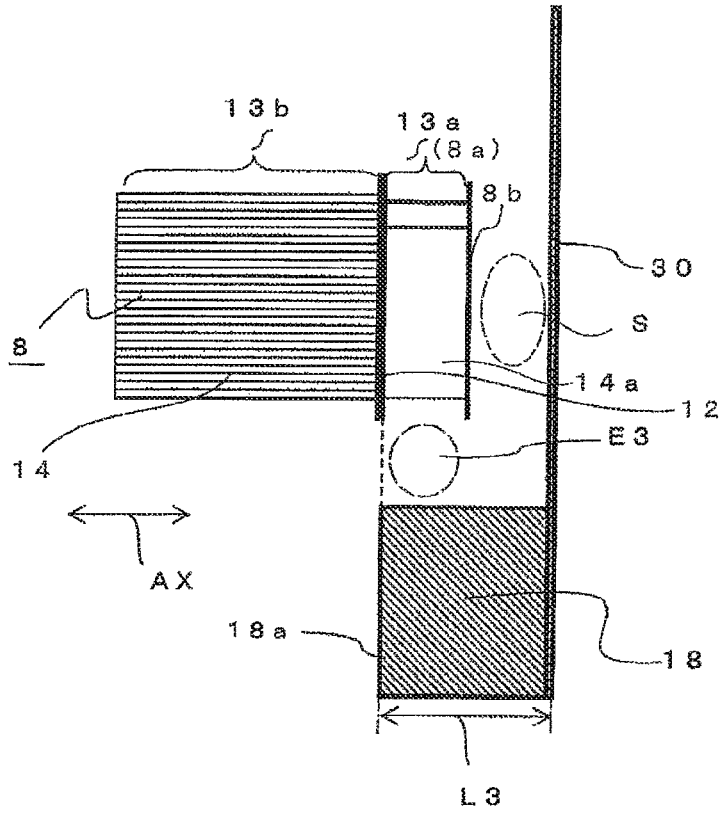
FIG. 24 is an explanatory view of an alternative example of the structure of the end unit of the cross flow fan according to Embodiments 1 to 3 of the present invention.

In Embodiments 1 to 3, the blades 13 of the both end units 14*a* out of the individual impeller units each have the two types of shapes, that is, the shape of the deflector opposing blade portion 13*a* opposite the deflector 18 and the shape of the air outlet opposing blade portion 13*b* opposing the air outlet 3 in the rotational axis direction AX. However, the shape of the blades 13 of the end units 14*a* is not limited to these. The support plate 12 between the units may be located at the position of the deflector end surface 18*a*. For example, FIG. 24 is an explanatory view of an alternative example of the structure of the end unit of the cross flow fan 8 according to Embodiments 1 to 3 of the present invention. As illustrated in FIG. 24, the fan extension 8*a* opposite the deflector 18 may have a single end unit 14*a*, the blades of which have the shape of that of the blade 13*a* having a short chord line as described in Embodiment 1, and the blade of the adjacent unit 14 may have the shape of the blade 13*b* having a long chord line. This is also applicable to the structures of Embodiments 2 and 3.

The blade of the fan extension 8*a* opposite the deflector 18 in the rotational axis direction AX does not necessarily entirely have a shape, with which the wind speed lower than the outlet airflow Ab blown from the blade portion 13*b* opposing the air outlet 3 can be obtained. That is, it is sufficient that, in the rotational axis direction AX, at least on each of the end sides of the cross flow fan 8, that is, near each of the fan end surface 8*b* sides of the blade 13 opposite the deflector 18, the blade portion has a shape with which the wind speed lower than that from the air outlet opposing blade portion 13*b* can be obtained. Since the pressure in the space S formed between each fan end surface 8*b* and a corresponding one of the side walls 30 is a low pressure space, it is preferable that the stagnation pressure P1 higher than the atmospheric pressure P0 be generated near the space S. Thus, when, at least at the end of the cross flow fan 8 in each fan extension 8*a*, a portion of the blade 13 near the fan end surface 8*b* side is the deflector opposing blade portion 13*a*, the outlet airflow Aa blown from the deflector opposing blade portion 13*a* impinges upon the deflector 18. Thus, the stagnation pressure P1 is generated in the impinging region E3, and accordingly, the effect of preventing reverse suction of the indoor air is produced. By preventing this reverse suction, turbulence of the airflow can be reduced, and accordingly, scattering of water droplets during cooling operation of the air-conditioning apparatus can be prevented. Thus, the performance of the fan can be improved.

The blade portions 13 opposing the air outlet 3 in the rotational axis direction AX are not necessarily entirely have the blade shape with which the wind speed higher than the outlet wind speed Va blown from the fan extensions 8*a* can be obtained. That is, referring to FIG. 8, all the blades 13 of the fan 8, the blades 13 opposing the air outlet 3 in a range from one of the deflector end surfaces 18*a* to the other deflector end surface 18*a*, are not necessarily have the blade shape with which the airflow flowing at a wind speed higher than that blown from the blade portions 13*a* of the fan extensions 8*a* can be obtained. As described above, because of assembly tolerances or the like, it is difficult for the deflector end surface 18*a* to be exactly aligned with the boundary portion of the blade shape. However, when at least the blades disposed in the fan central portion 8*c* (see FIG. 8) have the blade shape of the air outlet opposing blade portion 13*b*, the wind speed of the outlet airflow blown from the fan central portion 8*c* can be maintained at high speed. Thus, the air volume of the entire fan can be reliably obtained, and accordingly, the performance of the fan can be improved.

According to the present invention, the deflector 18, upon which the outlet airflow from the fan extension 8*a* impinges, are provided in the main body of the air-conditioning apparatus, that is, the indoor unit 1 main body. With this structure, the airflow is caused to impinge upon the deflector 18, thereby generating the stagnation pressure P1 (>atmospheric pressure P0). The shape of the deflector opposing blade portion 13*a* opposite the deflector 18 and the shape of the air outlet opposing blade portion 13*b* opposing the air outlet 3 are different from each other. For example, the lengths of the chord lines M are different from each other in Embodiment 1, the sizes of the outlet angles α are different from each other in Embodiment 2, and the sizes of the camber angles β are different from each other in Embodiment 3. However, the relationships among the lengths of the chord lines and the sizes of the outlet angles α and the camber angles β are not limited to these. There may be differences in two of the length of the chord line M, the size of the outlet angle α, and the size of the camber angle β between the deflector opposing blade portion 13*a* and the air outlet opposing blade portion 13*b*, or there may be differences in all of these length and sizes. It is sufficient that a structure, with which the wind speed Va of the outlet airflow Aa directed toward the deflector 18 be lower than the wind speed Vb of the outlet airflow Ab directed toward the air outlet 3, be realized. The deflector opposing blade portion 13*a* has the blade shape so that a minimum wind speed required to increase the stagnation pressure P1, which is obtained by the impinging flow, to a pressure higher than the atmospheric pressure P0 can be obtained. Thus, reverse suction can be prevented, and furthermore, the energy loss can be reduced as well as noise can be reduced. In addition, the air outlet opposing blade portion 13*b* has the blade shape, with which the wind speed Vb of the outlet airflow Ab blown from the air outlet 3, the wind speed Vb being higher than the wind speed Va of the outlet airflow Aa blown from the deflector opposing blade portion 13*a*, can be obtained. Thus, the air volume can be increased by the entirety of the fan so as to improve the performance of the fan, and an air-conditioning apparatus of reduced power consumption can be obtained.

In order to obtain different wind speeds of airflows from the blade shapes of the deflector opposing blade portion 13*a* and the air outlet opposing blade portion 13*b*, for example, the blade thicknesses may be different from each other. Here, the blade thickness refers to the width between the positive pressure surface 19 and the negative pressure surface 20 of the blade in a section perpendicular to the rotational axis 17. That is, the blade thickness of the deflector opposing blade portion 13*a* of the fan extension 8*a* opposite the deflector 18 is set to be smaller than that of the air outlet opposing blade portion 13*b*. An air path is larger between the blades having a small blade thickness than between the blades having a large blade thickness. Thus, the speed of an airflow passing between the blades having a small blade thickness is lower than that of an airflow passing between the blades having a large blade thickness. Accordingly, an outlet airflow flowing at the wind speed Va, which is lower than the wind speed Vb of the outlet airflow Ab blown from the air outlet opposing blade portion 13*b*, can be obtained with the deflector opposing blade portion 13*a*. In this case, the blade thicknesses are not necessarily different from each other over the entire blade shape from the inner circumferential blade end portion H to the outer circumferential blade end portion G. The effect similar to that obtained in Embodiments 1 to 3 can be obtained when the blade thicknesses are different at least near the outer circumferential blade end portion G, which is a portion that particularly affects airflows directed toward the deflector 18 and the air outlet 3.

The fan extension 8*a* of the fan 8 opposite the deflectors 18 may include one individual impeller unit, in which the pitch of the blades of the individual impeller unit 14*a* may be different from that of the blades 13 of the individual impeller unit 14 located in the fan central portion 8*c*. That is, the deflector opposing blade portions 13*a* of the fan extension 8*a* opposite the deflector 18 may be spaced apart from one another by a pitch larger than a pitch by which the blades 13 of the individual impeller unit 14 located in the fan central portion 8*c* are spaced apart from one another. When the pitch of the deflector opposing blade portions 13*a* of the fan extension 8*a* is increased, the speed at which the air flows between the blades is reduced. Thus, in the impinging region E3 opposite the deflector 18, an outlet airflow flowing at a wind speed lower than a wind speed of an outlet airflow blown from the blade 13 in the fan central portion 8*c* can be obtained.

The fan extension 8*a* of the fan 8 opposite the deflector 18 may include one individual impeller unit, in which the number of the deflector opposing blade portions 13*a* of the individual impeller unit 14*a* may be less than the number of the blades 13 of the individual impeller unit 14 located in the fan central portion 8*c*. When the number of the deflector opposing blade portions 13*a* of the fan extension 8*a* is reduced, energy provided to the airflow is less than that in the fan central portion 8*c*. Thus, in the impinging region E3 opposite the deflector 18, an outlet airflow flowing at a wind speed lower than the wind speed of the outlet airflow blown from the blade 13 in the fan central portion 8*c* can be obtained.

In either case, in the fan extension 8*a* provided at each end of the fan 8, at least the impinging region E3 needs to be in an atmosphere of the stagnation pressure P1 higher than the atmospheric pressure P0 by blowing the outlet airflow flowing at a lower wind speed than the wind speed of the outlet airflow blown from the blade 13 in the fan central portion 8*c*.

As described above, "to have the blade shapes different from each other" includes the case where there are differences in pitch of the blades, number of the blades, positions at which the blades are secured to the support plate, and the like between the blade shapes in addition to the case where there are differences in shape of the section perpendicular to the rotational axis 17 of the fan, that is, in thickness, chord line M, camber line, outlet angle α, camber angle β, and the like between the blade shapes.

The shape of the deflector 18 is not limited to the shape illustrated in FIG. 6. Here, although the distance between the deflector 18 and the outer circumference of the blade is substantially uniform over a range from the upstream side 10*a* to the downstream side of the rear guide 10 (see sign Y in FIG. 7), the distance between the deflector 18 and the outer circumference of the blade is not limited to this. The distance between the deflector 18 and the blade outer diameter 24 may vary over a range from a central portion toward the downstream side of the rear guide 10. Any shape may be used as long as the stagnation pressure P1 higher than the atmospheric pressure P0 is generated near the deflector 18 near each end of the air outlet 3.

The deflector 18 may be integrally formed with the rear guide 10 by, for example, resin molding, or may be separately formed from the rear guide 10 and, for example, fitted into the rear guide 10 at each end of the rear guide 10 in the longitudinal direction (rotational axis direction AX). The separately formed deflector 18 is convenient in order to change the shape, width, thickness, or the like in accordance with the capacity or the like of the indoor unit 1.

The invention claimed is:

1. An air-conditioning apparatus comprising:

an indoor unit main body having an air inlet through which indoor air is sucked, and an air outlet from which air is blown, the air outlet being elongated in a horizontal direction of the indoor unit main body;

a cross flow fan provided in the indoor unit main body in which a length thereof in a rotational axis direction is longer than a length of the air outlet in a longitudinal direction such that the cross flow fan extends beyond both ends of the air outlet in the longitudinal direction and the rotational axis direction of the cross flow fan matches the horizontal direction of the indoor unit main body; and deflectors provided in the indoor unit main body, the deflectors opposing airflows blown from extensions being portions of the cross flow fan, the extensions being positioned beyond the both ends of the air outlet in the longitudinal direction, wherein the cross flow fan includes a plurality of individual impeller units, each of the plurality of individual impeller units has a plurality of blades provided in a circumferential direction of annular support plates, the plurality of individual impeller units includes a pair of individual impeller units positioned at the both ends of the longitudinal direction, wherein each of the plurality of blades provided to the pair of individual impeller units comprises a first blade portion and a second blade portion, wherein the first blade portion opposing the air outlet is differently shaped from the second blade portion in the extensions opposing the deflectors, wherein the first blade portion and the second blade portion of the plurality of blades of the individual impeller unit are disposed between two of the annular support plates adjacent each other, and wherein, in a section of each of the plurality of blades perpendicular to the rotational axis, for each of the plurality of blades, in a case that a locus of rotation of an outer circumferential blade end portion is defined as blade outer diameter, that a line that extends in a center between a positive pressure surface as a negative pressure surface is defined as a camber line, the positive pressure surface being at a front in a rotational direction of the blade, the negative pressure surface being at a rear in the rotational direction of the blade, and that an angle formed between a tangent of the blade outer diameter and a tangent of the camber line at an intersection of the blade outer diameter and the camber line is defined as an outlet angle $\alpha$, an outlet angle $\alpha a$ of the second blade portion is smaller than an outlet angle $\alpha b$ of the first blade portions opposing the air outlet.

2. The air-conditioning apparatus of claim 1, wherein, in a section of each of the plurality of blades perpendicular to the rotational axis, for each of the plurality of blades, when a line segment that connects an outer circumferential blade end portion and an inner circumferential blade end portion is defined as a chord line M, a length of a chord line Ma of the second blade portion is shorter than a length of a chord line Mb of the first blade portion opposing the air outlet.

3. The air-conditioning apparatus of claim 1, wherein, for each of the plurality of blades, a boundary portion between the second blade portion and the first blade portion opposing the air outlet has a blade shape of a straight line, a concave curve or a convex curve.

4. The air-conditioning apparatus of claim 1, wherein the cross flow fan includes a plurality of the individual impeller units being connected to one another in the rotational axis direction.

5. The air-conditioning apparatus of claim 1, further comprising a heat exchanger provided in the indoor unit main body, the heat exchanger configured to heat-exchange with the indoor air sucked through the air inlet.

6. An air-conditioning apparatus comprising:

an indoor unit main body having an air inlet through which indoor air is sucked, and an air inlet from which air is blown, the air outlet being elongated in a horizontal direction of the indoor unit main body;

a cross flow fan provided in the indoor unit main body in which a length thereof in a rotational axis direction is longer than a length of the air outlet in a longitudinal direction such that the cross flow fan extends beyond both ends of the air outlet in the longitudinal direction and the rotational axis direction of the cross flow fan matches the horizontal direction of the indoor unit main body; and deflectors provided in the indoor unit main body, the deflectors opposing airflows blown from extensions being portions of the cross flow fan, the extensions being positioned beyond the both ends of the air outlet in the longitudinal direction, wherein the cross flow fan includes a plurality of individual impeller units, each of the plurality of individual impeller units has a plurality of blades provided in a circumferential direction of annular support plates, the plurality of individual impeller units includes a pair of individual impeller units positioned at the both ends of the pair longitudinal direction, wherein each of the plurality of blades provided to the pair of individual impeller units comprises a first blade portion and a second blade portion, wherein the first blade portion opposing the air outlet is differently shaped from the second blade portion in the extensions opposing the deflections, wherein the first blade portion and the second blade portion of the plurality of blades of the individual impeller unit are disposed between two of the annular support plates adjacent each other, wherein, in a section of each of the plurality of blades perpendicular to the rotational axis, for each of the plurality of blades, in a case that a line that extends in a center between a positive pressure surface and a negative pressure surface is defined as a camber line, the positive pressure surface being at a front in a rotational direction of the blade, the negative pressure surface being at a rear in the rotational direction of the blade, and that a central angle of a sector, an arc of which is the camber line, is defined as a camber angle β, a camber angle βa of the second blade portion is smaller than a camber angle βb the first blade portions opposing the air outlet.

7. The air-conditioning apparatus of claim 6, wherein, in a section of each of the plurality of blades perpendicular to the rotational axis, for each of the plurality of blades, when a line segment that connects an outer circumferential blade end portion and an inner circumferential blade end portion is defined as a chord line M, a length of a chord line Ma of the second blade portion is shorter than a length of a chord line Mb of the first blade portion opposing the air outlet.

8. The air-conditioning apparatus of claim 6, wherein, for each of the plurality of blades, a boundary portion between the second blade portion and the first blade portion opposing the air outlet has a blade shape of a straight line, a concave curve or a convex curve.

9. The air-conditioning apparatus of claim 6, wherein the cross flow fan includes a plurality of the individual impeller units being connected to one another in the rotational axis direction.

10. The air-conditioning apparatus of claim 6, further comprising a heat exchanger provided in the indoor unit main body, the heat exchanger configured to heat-exchange with the indoor air sucked through the air inlet.

* * * * *